US009504294B2

(12) United States Patent
Hasegawa et al.

(10) Patent No.: US 9,504,294 B2
(45) Date of Patent: Nov. 29, 2016

(54) FEMALE SNAP BUTTON AND SNAP BUTTON

(71) Applicant: YKK CORPORATION, Tokyo (JP)

(72) Inventors: Kenji Hasegawa, Tokyo (JP); Hisanori Kato, Tokyo (JP); Yuki Asano, Tokyo (JP); Hiroki Fukushima, Tokyo (JP); Tomoko Taguchi, Tokyo (JP)

(73) Assignee: YKK Corporation (JP)

( * ) Notice: Subject to any disclaimer, the term of this patent is extended or adjusted under 35 U.S.C. 154(b) by 256 days.

(21) Appl. No.: 14/359,119

(22) PCT Filed: Nov. 29, 2012

(86) PCT No.: PCT/JP2012/080999
§ 371 (c)(1),
(2) Date: May 19, 2014

(87) PCT Pub. No.: WO2013/121650
PCT Pub. Date: Aug. 22, 2013

(65) Prior Publication Data

US 2014/0325797 A1 Nov. 6, 2014

(30) Foreign Application Priority Data

Feb. 15, 2012 (JP) ..... PCT/JP2012/053567

(51) Int. Cl.
*A44B 17/00* (2006.01)

(52) U.S. Cl.
CPC ..... *A44B 17/0041* (2013.01); *A44B 17/0011* (2013.01); *A44B 17/0052* (2013.01); *A44B 17/0076* (2013.01); *Y10S 24/52* (2013.01); *Y10T 24/366* (2015.01); *Y10T 24/45178* (2015.01)

(58) Field of Classification Search
CPC ..... A44B 17/0041; A44B 17/0011; A44B 17/0052; A44B 17/0076; Y10T 24/45178; Y10T 24/366; Y10T 24/45775; Y10S 24/51; Y10S 24/52
See application file for complete search history.

(56) References Cited

U.S. PATENT DOCUMENTS 1,735,620 A * 11/1929 Salley ..... A44B 17/0011 24/110
2,552,764 A 5/1951 Bedford
5,970,588 A 10/1999 Hurtz et al.

FOREIGN PATENT DOCUMENTS

DE 2902181 A 7/1980
GB 2171446 A 8/1986

(Continued)

OTHER PUBLICATIONS

International Preliminary Report on Patentability, PCT Application No. PCT/JP2012/080999, mailed Aug. 28, 2014.

(Continued)

*Primary Examiner* — Robert J Sandy
(74) *Attorney, Agent, or Firm* — Kilpatrick Townsend & Stockton LLP

(57) ABSTRACT

A female snap is provided with: a first member for at least partially establishing an opening into which a post is inserted; and a second member which is able to restrict expansion of the opening in order to either increase the force needed for engagement/disengagement, or prohibit engagement/disengagement, of the post with respect to the female snap. The extent of expansion of the opening that is permitted by the second member varies depending on the relative positions of a contracting part of the second member and a contacted part of the first member in a peripheral direction going around the direction of insertion of the post into the opening.

20 Claims, 34 Drawing Sheets

(56) References Cited

FOREIGN PATENT DOCUMENTS

| | | | |
|---|---|---|---|
| JP | 59-2208 | | 1/1984 |
| JP | 61-170304 | | 10/1986 |
| JP | 2003-310310 | A | 11/2003 |
| JP | 4659671 | B2 | 3/2011 |
| WO | 97/28714 | A1 | 8/1997 |

OTHER PUBLICATIONS

International Search Report, PCT Application No. PCT/JP2012/080999, Feb. 19, 2013.

International Search Report, PCT/JP2012/080999, Feb. 19, 2013, 4 pgs.

* cited by examiner (a)

(b)

(a)

(b)

(a)

(b)

(a)

(b)

FEMALE SNAP BUTTON AND SNAP BUTTON

This application is a national stage application of PCT/JP2012/080999, which claims priority to PCT/JP2012/053567, both of which are incorporated herein by reference.

TECHNICAL FIELD

The present invention relates to a female snap button and a snap button.

BACKGROUND ART

Patent document 1 discloses a fastener having a lock function. More specifically, a female snap 1 has: a stopper 5 upwardly urged by a spring member 12; an engagement member 6 shaped as shown in its FIG. 2; and an elastic ring 10 mounted on an engagement portion 17 of the engagement member 6. FIGS. 6(a) and (b) disclose snap-in process of the male snap 2 with the female snap 1. When the male snap 2 is removed from the female snap 1, a key bar 22 is utilized to push the stopper 5 down as shown in FIG. 6 (d). Accordingly, the engagement portion 17 of the engagement member 6 is allowed to expand freely externally, thereby achieving the removal of the male snap 2 from the female snap 1.

Patent document 2 discloses a female body 5 in which an integrated part having a fixed portion 7 and a fitting projection 9 and made of molding material of an elastic rigid resin is housed in a housing 15. It is described that, when a male body 3 is pressed therein, the fitting projection 9 is much further bent in the press-in direction and the fixed portion 5 is expanded toward the surrounding side tube 20 of the housing 15, thereby an easier press-in of the male body being secured.

Patent document 3 discloses a female part provided with a circular groove 5 at a surrounding wall 3 rising from the periphery of a base plate 2, wherein when an inner surrounding wall portion 3a is elastically transformed radially outwardly, only its top end contacts with an outer surrounding wall portion 3b, preventing its further elastic transformation. As shown in its FIG. 1, a bulge 7 is provided generally continuously in the circumferential direction at the inner side of the inner surrounding wall portion 3a, thereby enough fitting against a protrusion of a male part being secured.

Patent document 4 discloses a female member in which a wave shaped circular engagement spring 7 having outer ridges 9 and inner ridges 10 is provided in a housing 6, and a slit 8 is provided at a portion other than the top 10A of the inner ridge 10.

CITATION LIST

Patent Literature

[PTL 1] Japanese Patent No. 4,659,671

[PTL 2] Japanese Utility Model Application Laid-open No. 61-170304

[PTL 3] Japanese Patent Application Laid-open No. 2003-310310

[PTL 4] Japanese Utility Model Application Laid-open No. 59-2208

SUMMARY OF INVENTION

Technical Problem

With Patent document 1, it may be necessary to move the stopper 5 up and down (in an attachment direction of the male snap 1) for unlocking the female snap 1 and the male snap 2. Accordingly, its configuration is expected to be more complicated, and the thickness of the female snap 1 is expected to be greater.

It is requested to regulate the engaging force of the female snap with a simple configuration.

Solution to Problem

A female snap button according to the present invention may be a female snap button with which a post of a male snap button is engageable and disengageable, the female snap button comprising:

a first member at least partially defining an aperture to which the post is inserted, the aperture being capable of expanding in accordance with the insertion of the post and capable of recovering from the expanded aperture width to its initial aperture width; and a second member capable of restricting the expansion of the aperture so as to increase the force required to engage and disengage the post for the female snap button or so as to prohibit it from engaging and disengaging therewith;

wherein the second member comprises at least one contact portion that is to be in contact with the first member, and the first member comprises at least one contacted portion that is to be contacted with the contact portion, and wherein the extent of the expansion of the aperture allowed by the second member varies in accordance with the relative position of the contact portion and the contacted portion in the circumferential direction that is around the insertion direction of the post into the aperture.

Preferably, one of the first member and the second member may be rotatable relative to the other member and, in accordance with this rotation, the extent of the expansion of the aperture allowed by the second member may be adjustable.

Preferably, the aperture may recover from the expanded aperture width to the initial aperture width based on the elasticity of the first member itself or based on the elasticity of at least one elastic member that directly or indirectly acts against the first member.

In a case where the aperture may recover from the expanded aperture width to the initial aperture width based on the elasticity of the at least one elastic member, the first member may be annularly configured and may include first and second U-shaped parts caused by dividing the annular first member; and the at least one elastic member may be a leaf spring that couples the first and second U-shaped parts or a leaf spring that urges one of the first and second U-shaped parts toward the other of the first and second U-shaped parts, preferably.

In a case where the aperture may recover from the expanded aperture width to the initial aperture width based on the elasticity of the first member itself, the contacted portion of the first member may preferably comprise a projection projecting toward the second member.

Preferably, the height of the projection may vary step-by-step in the circumferential direction.

Preferably, the contact portion of the second member may comprise a projection projecting toward the first member.

Preferably, the second member may be rotatably mounted on the first member, the contact portion of the second member may comprise a contact leg that projects from the second member to the first member side in the stacking direction of the first member and the second member.

Preferably, a rotator may be further provided which is mounted on the first member and conveys a torque to the first member A snap button according to the present invention may comprise any of above described female snap button and a male snap button that comprises a post that is to be inserted to the aperture of the first member of the female snap button.

A female snap button according to the present invention may comprise:

a first member that transforms in a transformation direction perpendicular to an insertion direction of a post of a male snap to allow the post being inserted and engages with the post; and a second member that is capable of restricting the transformation of the first member in the transformation direction, wherein the second member may comprise at least one contact portion that is to be in contact with the first member, and the first member may comprise at least one contacted portion that is to be contacted with the contact portion, and wherein the degree of the transformation of the first member allowed by the second member varies in accordance with the relative position of the contact portion and the contacted portion in a circumferential direction that is centered around the insertion direction.

Preferably, one of the first member and the second member may be rotatable relative to the other member and, in accordance with this rotation, the degree of the transformation of the first member allowed by the second member may be adjustable.

Preferably, the transformed first member may recover to its initial form based on the elasticity of the first member itself or based on the elasticity of at least one elastic member that directly or indirectly acts against the first member In a case where the transformed first member may recover to its initial form based on the elasticity of the at least one elastic member that directly or indirectly acts against the first member, the first member may be annularly configured and includes first and second U-shaped parts caused by dividing the annular first member; and the at least one elastic member may be a leaf spring that couples the first and second U-shaped parts or a leaf spring that urges one of the first and second U-shaped parts toward the other of the first and U-shaped parts, preferably.

In a case where the transformed first member may recover to its initial form based on the elasticity of the first member itself, the contacted portion of the first member may preferably comprise a projection projecting toward the second member.

A rotator may preferably be further provide which is mounted on the first member and conveys a torque to the first member Preferably, at least one of the first member and the second member may be rotatable within a predetermined angular range.

Advantageous Effects of Invention

According to the present invention, the engaging force of the female snap may be adjustable with a simple configuration.

DESCRIPTION OF EMBODIMENTS

Hereinafter, embodiments of the present invention will be described with reference to drawings. Each embodiment may not be exclusive one another, and a skilled person may be able to unify two or more of them if necessary and may appreciate the unified effect of such unifying without an excess explanation. In general, duplicative explanation among embodiments shall be omitted. The referenced drawings may be mainly for describing inventions and may be simplified depending on occasions.

An axis AX is illustrated in main drawings for the sake of explanation. The axis AX may correspond to a depth direction of a receiving portion of a female snap/an extending direction of a post of a male snap/an insertion direction of a post of a male snap, for example. The axis AX may also correspond to the stacking direction of a ring body and a rotator as described later. For the sake of convenience of description, in general and throughout the specification, a direction extending along the axis AX may be referred to as up and down direction, and a direction extending perpendicular to the axis AX may be referred to as radial direction for the description of each and every embodiment. A direction along the radial direction toward the axis AX may be referred to as inward, and a direction along the radial direction away from the axis AX may be referred to as outward. A direction around the axis AX may be referred to as circumferential direction. As will be apparent from the following descriptions, when a post of a male snap is inserted into a receiving portion of a female snap, an elastic body (a ring body 40, and a ring rotator 70) may transform in a direction identical to the radial direction. If a direction of an elastic body (a ring body 40 and a ring rotator 70) being transformed is defined as a transformation direction, it may be appreciated that the transformation direction corresponds to the radial direction in the following embodiments.

1st Embodiment

Figure 1:
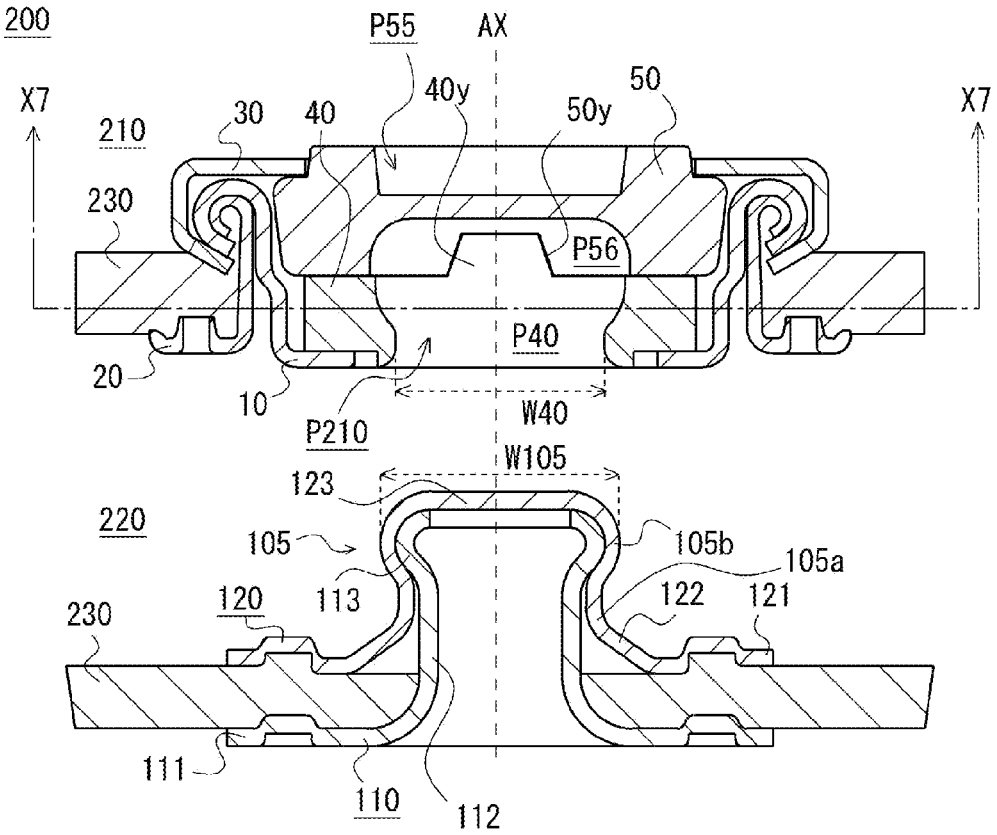
FIG. 1 is a schematic cross-sectional view of a snap button in accordance with a first embodiment of the invention.
Figure 2:
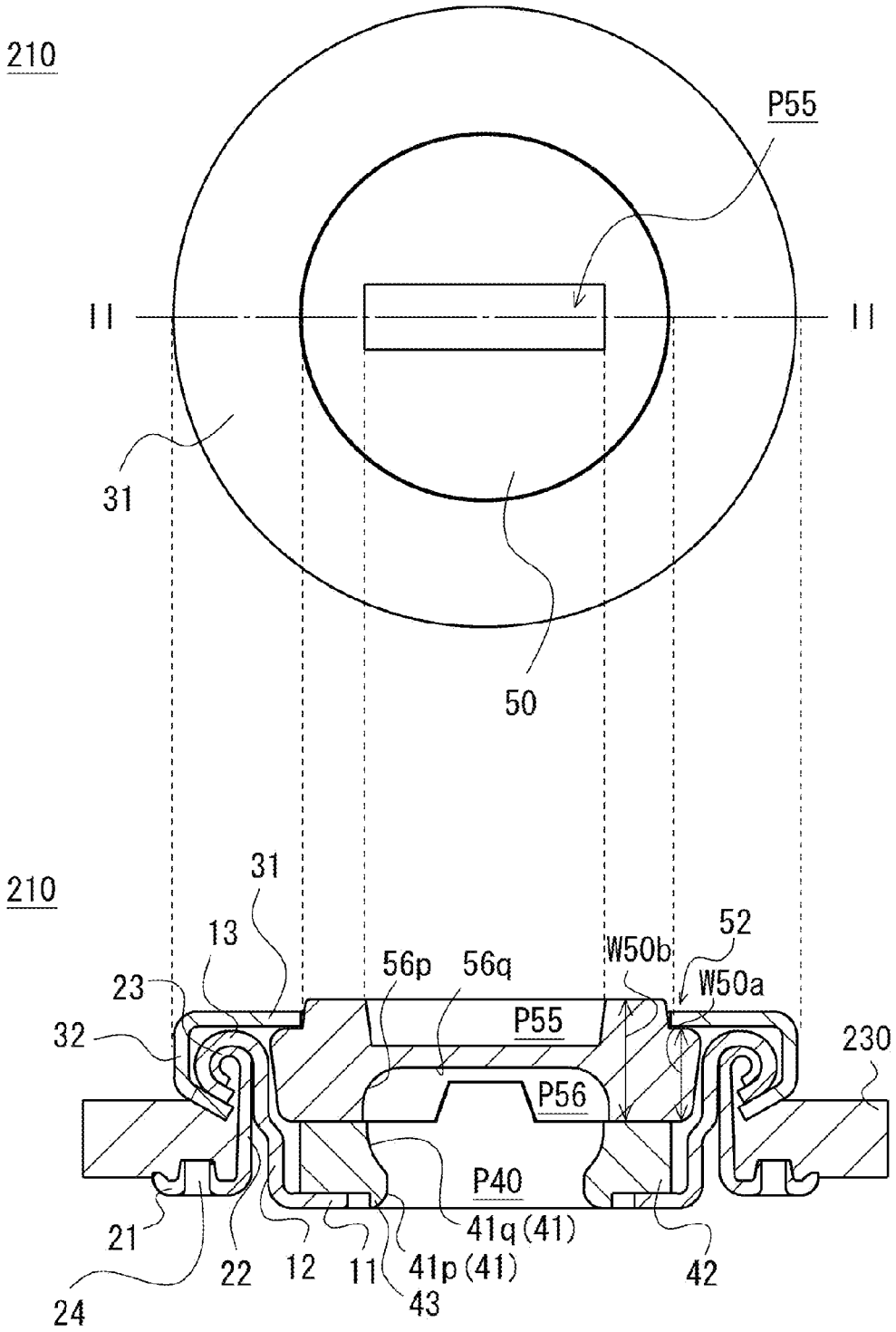
FIG. 2 illustrates schematic top and cross-sectional views of a female snap in accordance with a first embodiment of the invention.
Figure 3:
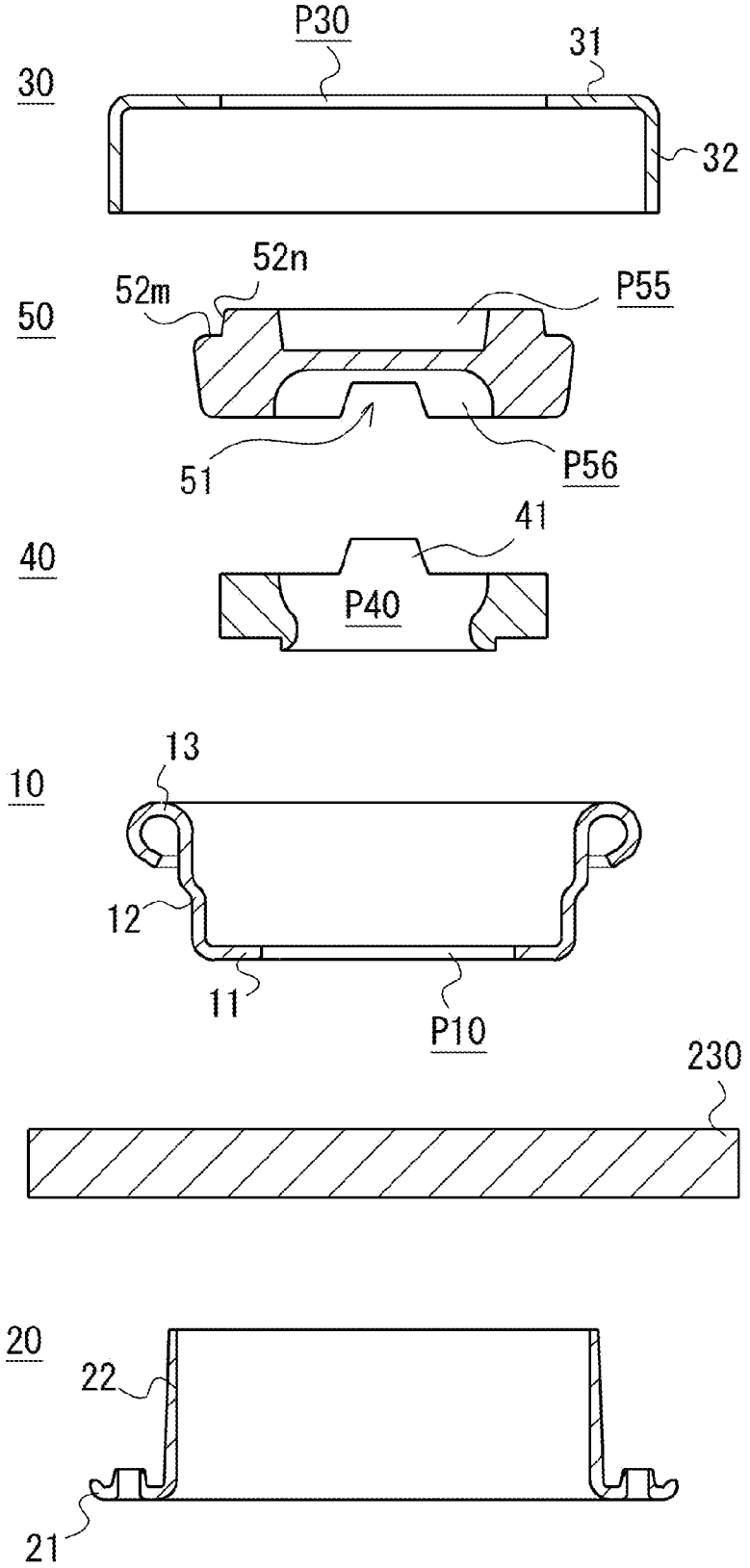
FIG. 3 is a schematic exploded cross-sectional view of a female snap before being assembled in accordance with a first embodiment of the invention.
Figure 4:
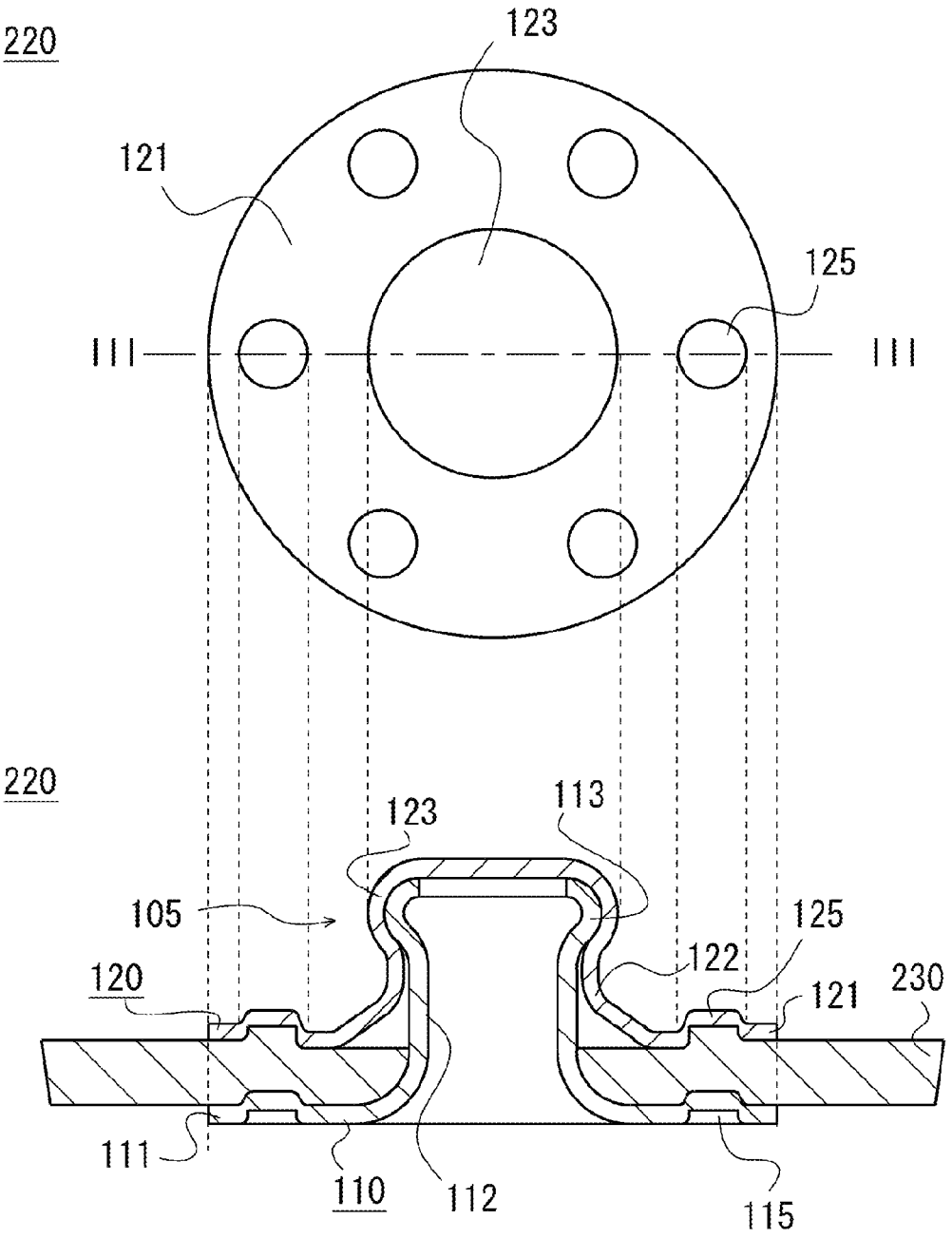
FIG. 4 illustrates schematic top and cross-sectional views of a male snap in accordance with a first embodiment of the invention.
Figure 5:
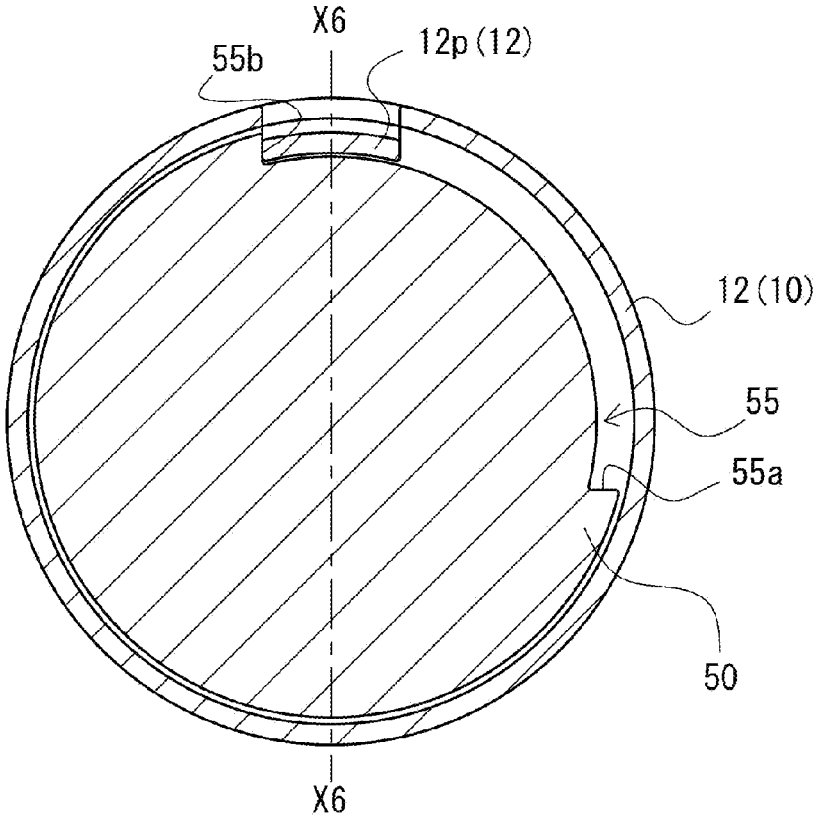
FIG. 5 is a schematic transverse cross-sectional view of a female snap taken along a dashed line X5-X5 shown in FIG. 6, illustrating a rotational angular range restriction structure.
Figure 6:
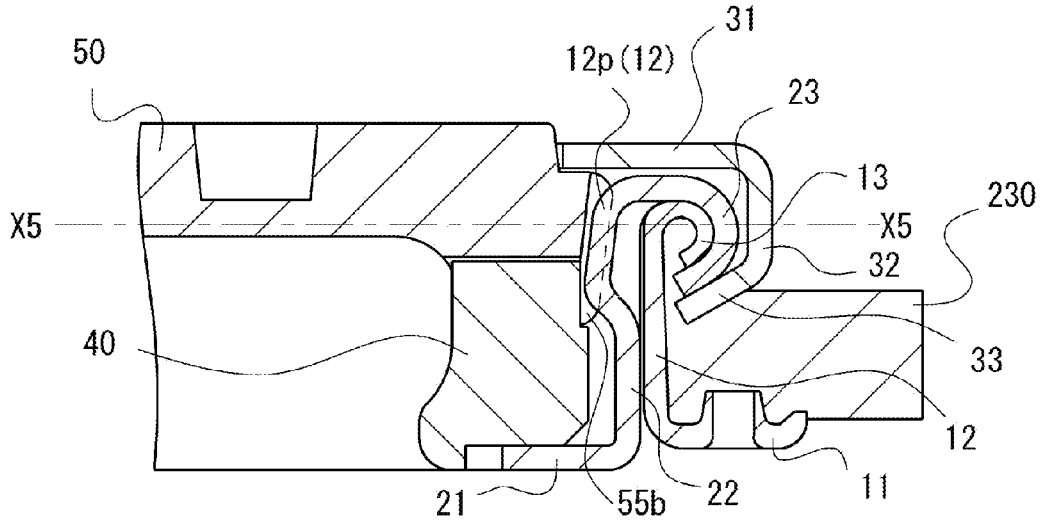
FIG. 6 is a schematic partial cross-sectional view of a female snap taken along a dashed line X6-X6 shown in FIG. 5.
Figure 7:
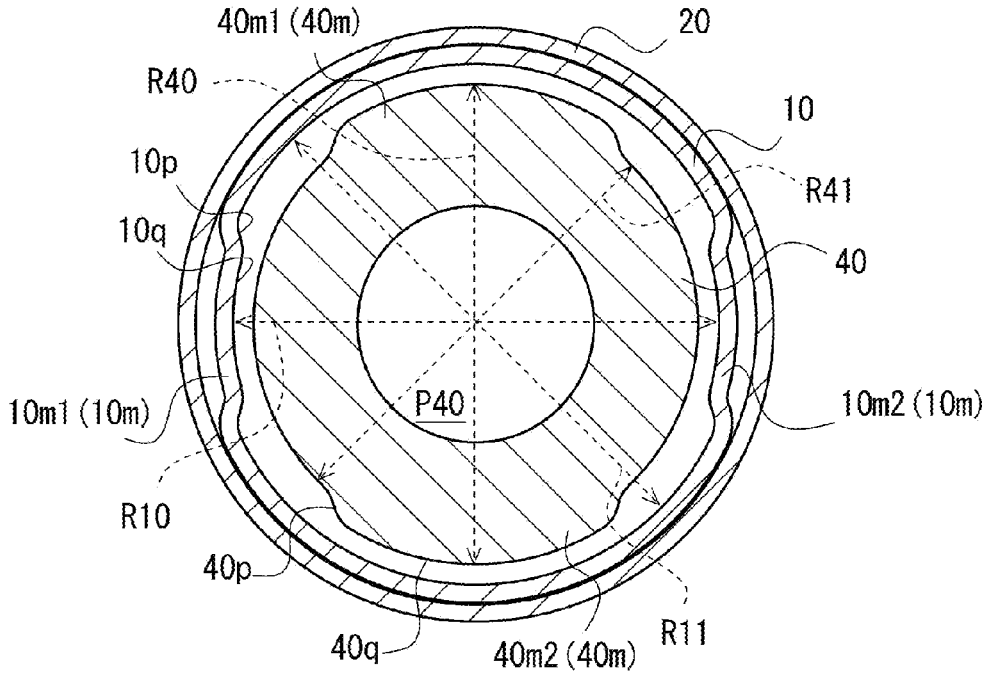
FIG. 7 is a schematic transverse cross-sectional view of a female snap in a weak-snap state taken along a dashed line X7-X7 shown in FIG. 1.
Figure 8:
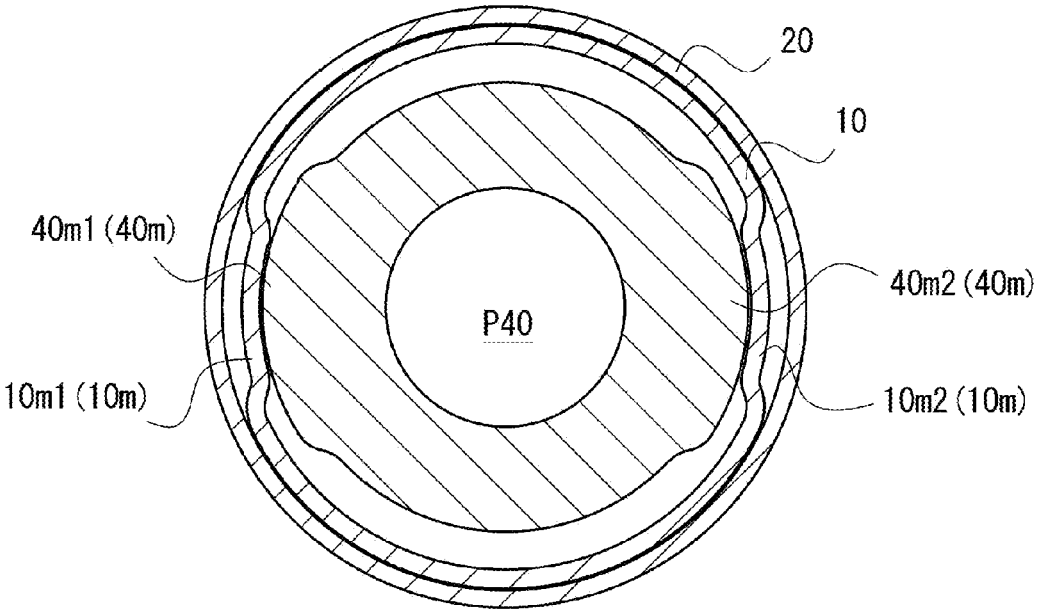
FIG. 8 is a schematic transverse cross-sectional view of a female snap in a strong-snap state taken along a dashed line X7-X7 shown in FIG. 1.
Figure 9:
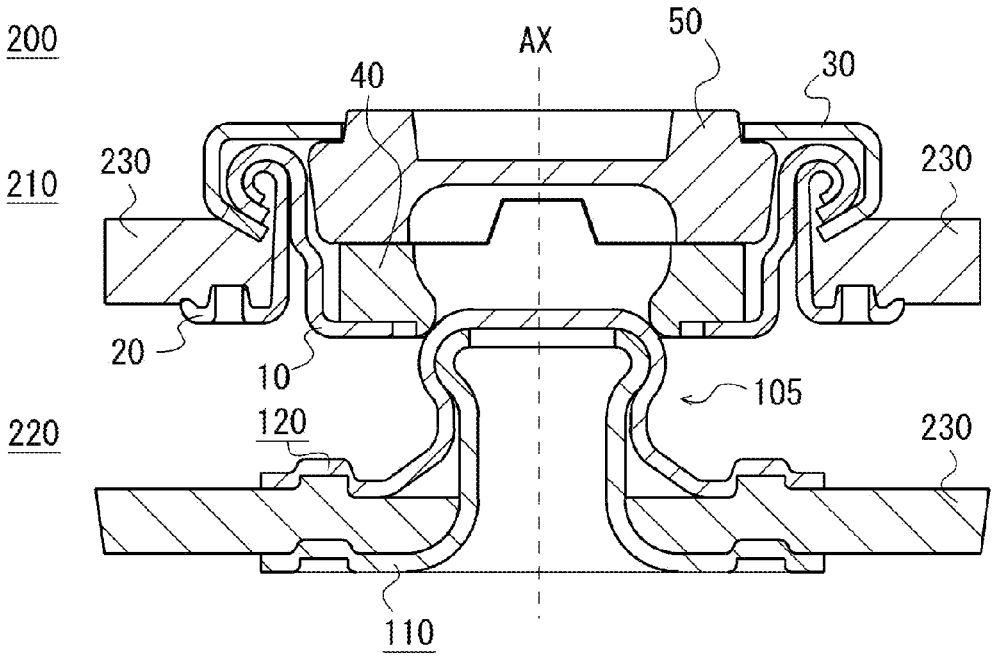
FIG. 9 is a schematic cross-sectional view illustrating a fitting process for male and female snaps in accordance with a first embodiment of the invention.
Figure 10:
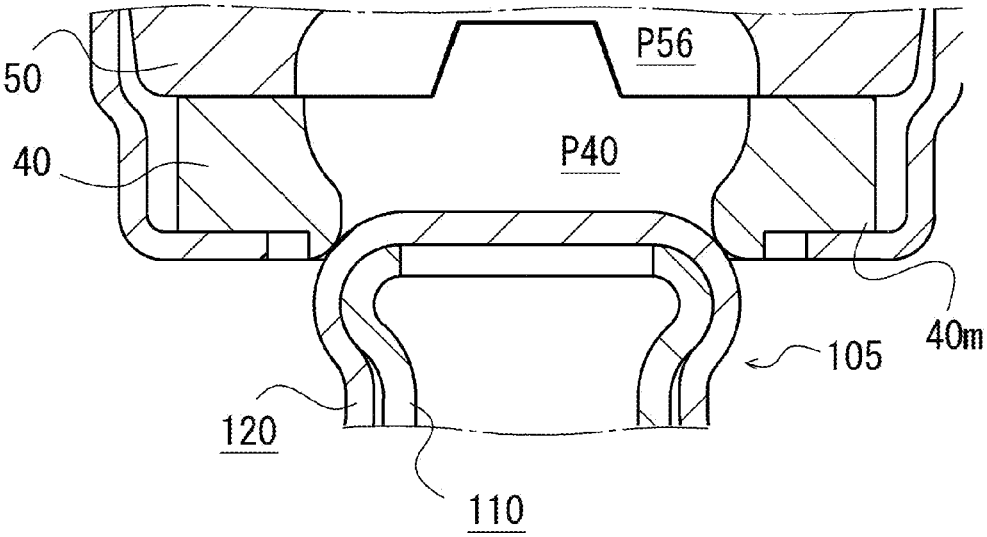
FIG. 10 is a schematic partially expanded cross-sectional view illustrating a fitting process for male and female snaps in accordance with a first embodiment of the invention.
Figure 11:
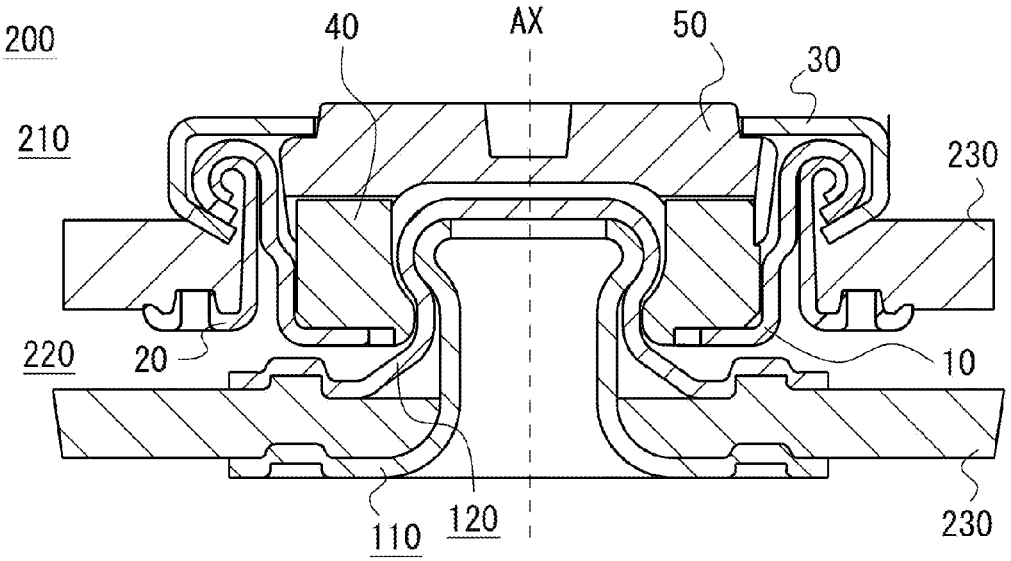
FIG. 11 is a schematic cross-sectional view illustrating a snap button in a strong-snap state in accordance with a first embodiment of the invention.

First embodiment will be described with reference to FIGS. 1-11. FIG. 1 is a schematic cross-sectional view of a snap button. FIG. 2 illustrates schematic top and cross-sectional views of a female snap. FIG. 3 is a schematic exploded cross-sectional view of a female snap before being assembled. FIG. 4 illustrates schematic top and cross-sectional views of a male snap. FIG. 5 is a schematic transverse cross-sectional view of a female snap taken along a dashed line X5-X5 shown in FIG. 6, illustrating a rotational angular range restriction structure. FIG. 6 is a schematic partial cross-sectional view of a female snap taken along a dashed line X6-X6 shown in FIG. 5. FIG. 7 is a schematic transverse cross-sectional view of a female snap in a weak-snap state taken along a dashed line X7-X7 shown in FIG. 1. FIG. 8 is a schematic transverse cross-sectional view of a female snap in a strong-snap state taken along a dashed line X7-X7 shown in FIG. 1. FIG. 9 is a schematic cross-sectional view illustrating a fitting process for male and female snaps. FIG. 10 is a schematic partially expanded cross-sectional view illustrating a fitting process for male and female snaps. FIG. 11 is a schematic cross-sectional view illustrating a snap button in a strong-snap state.

As shown in FIG. 1, a snap button 200 has a female snap button 210 (hereinafter sometimes simply referred to as a female snap 210) and a male snap button 220 (hereinafter sometimes simply referred to as a male snap 220) which are fixed to a fabric 230. A post 105 of the male snap 220 is to be inserted into a receiving portion P210 of the female snap 210, and the post 105 is to be held by the receiving portion P210, thus the female snap 210 and the male snap 220 being coupled in up and down direction. Pulling the post 105 out of the receiving portion P210 may separate the female snap 210 and the male snap 220 in up and down direction. It should be noted that the fabric 230 may be formed, but not limited to, by two-dimensionally weaving yarns of natural fibers, chemical fibers (polyester system or nylon system fibers) and so on, and may be a sheet formed of an unwoven cloth, a natural/synthetic leather, a felt, a resin such as a plastic resin and so on. The fabric 230 may be simply referred to as a sheet.

As shown in FIGS. 1-3, the female snap 210 has a can body (a second member) 10, an attachment body 20, a cover 30, a ring body (a first member, an annular member) 40, and a rotator 50. The female snap 210 is a disk-like member viewed from above as shown in FIG. 2. The can body 10, the attachment body 20, and the cover 30 form a frame member which is for containing the ring body 40 and the rotator 50 and which is suitable for the attachment of the ring body 40 and the rotator 50 for the fabric. Each may be produced by shaping flat plates of a metal and so on through any arbitrary process. The can body 10, the attachment body 20, and the cover 30 form the frame member which is arranged to sandwich the fabric 230 by its outer periphery from above and from below and to carry the ring body 40 and the rotator 50 at its inner periphery. The ring body 40 and the rotator 50 are stacked such that they are rotatable together around the axis AX. The stacking direction corresponds to the axis AX.

The ring body 40 and the rotator 50 are structurally fitted together and are rotatable together around the axis AX. More specifically, as shown in FIG. 1, the ring body 40 has an engagement protuberance 40*y* at its top side, and the rotator 50 has an engagement dent 50*y* at its underside. The engagement protuberance 40*y* extends upward, and the engagement dent 50*y* is depressed upward. The engagement protuberance 40*y* and the engagement dent 50*y* fit together so that the torque applied to the rotator 50 is transferred to the ring body 40, resulting in the rotation of the ring body 40 caused by the use of the rotator 50. The ring body 40 and the rotator 50 are separated so that it may be possible to select an optimal material based on the respective functions of both components. However, this feature may not be a prerequisite, and the ring body 40 and the rotator 50 may be unified.

The ring body 40 and the rotator 50 are stacked such that the inner side of the ring body 40 and the inner side of the depressed portion P56 of the rotator 50 are coupled continuously, thereby forming the receiving portion P210 that is for receiving the post 105 of the male snap 220. The minimum diameter W40 of the receiving mouth of the receiving portion P210 (the receiving mouth of the ring body 40) is less than the maximum diameter W105 of the post 105. Therefore, the ring body 40 will be forced to deform radially outwardly so that the diameter W40 of the receiving mouth of the ring body 40 may expand, allowing the entry of the post 105 into the receiving portion P210. The receiving portion P210 may be sized to be large enough for accommodating the post 105 which has passed through the receiving month.

As shown in FIG. 1, the can body 10 may be a housing member that may house the ring body 40 and the rotator 50 and may be fixed to the fabric 230 by the attachment body 20. The can body 10 may be closed by the cover 40 from above while the ring body 40 and the rotator 50 are housed in the can body 10. The can body 10, the attachment body 20, and the cover 30 may be made of metal material having a plastic deformation feature such as brass, copper alloy, stainless steel, aluminum and so on, for example. The ring body 40 may have an elasticity of arbitrary modulus and may be made of material of a synthetic resin and so on such as polyester, polyamide, polyurethane, polyacetal, polybutylene terephthalate and etc., for example. The rotator 50 may be made of material such as the above-mentioned synthetic resin having a desired strength, the above-mentioned metal material and so on.

More detail explanation about the can body 10, the attachment body 20, and the cover 30 will be made with reference to FIG. 2. As show in the lower section of FIG. 2, the can body 10 has a bottom part 11, a tube 12, and a bend 13. A hole P10 is opened at the center of the bottom part 11 (see FIG. 3), and the bottom part 11 is annularly shaped. The ring body 40 is mounted on the bottom part 11. The tube 12 extends along the axis AX and rises from the outer rim of the bottom part 11, and forms a peripheral wall surrounding the ring body 40. A top end of the tube 12 may be radially outwardly and downwardly curbed so that the top end of the bend 13 may be directed to face the outer side of the tube 12, thus forming a curved shape of the bend 13. The bend 13 is an engagement part for engaging with the attachment body 20.

The attachment body 20 has a press part 21, a tube 22, and a bend 23. The press part 21 extends radially outwardly from the lower end of the tube 22 and presses the fabric 230 from below. The tube 22 extends along the axis AX and rises from the inner rim of the press part 21, and forms a peripheral wall surrounding the ring body 40 together with the tube 12 of the can body 10. A top end of the tube 22 may be radially outwardly and downwardly curbed so that the top end of the bend 23 may be directed to face the outer side of the tube 22, forming the curved shape of the bend 23. The bend 23 may be an engagement part for engaging with the can body 10.

For example, a top end of the tube 22 may be inserted to the bend 13 of the can body 10 and may be pressed and curved by the contact surface of the bend 13, thus the bend 23 being shaped (see also FIG. 3). The press part 21 of the attachment body 20 is provided with a punch dent 24 and therefore a bite portion 25 against the fabric 23 is produced at the press part 21. The attachment body 20 bites the fabric 230 so that the attachment body 20 may be firmly fixed to the fabric 230.

The cover 30 has a flat plate 31 and an outer skirt 32. The flat plate 31 is provided with an opening P30 at its center (see FIG. 3) and the flat plate 31 is annularly configured. The open end of the flat plate 31 may be a position-restricting part for confining the ring body 40 and the rotator 50 within the can body 10. The outer skirt 32 extends downwardly along the axis AX from the outer rim of the flat plate 31. The lower end section of the outer skirt 32 is bent such that it ramps inwardly. This flexure of the lower end section of the outer skirt 32 of the cover 30 may fix the cover 30 against the can body 10 and, at the same time, the ring body 40 and the rotator 50 may be confined within the can body 10 by the flat plate 31 of the cover 30. The lower end section of the outer skirt 32 of the cover 30 may also be a press part for the fabric 230 from above, thereby the fabric 230 being preferably sandwiched from above and from below between the lower end section of the outer skirt 32 of the cover 30 and the press part 21 of the attachment body 20.

As shown in FIGS. 1 and 2, the ring body 40 may be an elastic body that is a flat plate member made of a resin, metal and so on and provided with an aperture P40 at the center thereof. As shown at the lower section of FIG. 2, the underside of the ring body 42 that is the main body of the ring body 40 is provided with an annular protrusion 43. The annular protrusion 43 is positioned in the hole P10 of the can body 10, thereby allowing easier positioning of the can body 10 and the ring body 40. The aperture diameter (aperture width) corresponding to the diameter of the aperture P40 of the ring body 42 is expandable, thereby allowing the insertion of the post 105 into the receiving portion P210/the draw of the post 105 out of the receiving portion P210. In this embodiment, as will be apparent from the following descriptions, the female snap 210 has a state in which the transformation of the aperture shape of the ring body 42 is restricted and a state in which the transformation of the aperture shape of the ring body 42 is NOT restricted. Each state may be determined by a relative position of the ring body 40 and the can body 10 in the circumferential direction.

As shown in the lower section of FIG. 2, the lower area 41*p* of the inner side 41 of the ring body 40 radially inwardly bulges in an arc, and the upper area 41*q* of the inner side 41 of the ring body 40 is radially outwardly depressed in an arc. The inner side 41 of the ring body 40 is shaped like a wave and the inside diameter of the ring body 40 fluctuates along the up and down direction accordingly. In particular, the inside diameter of the ring body 40 gradually narrows and then gradually widens in the direction from below to above.

The rotator 50 may be a disk-like component provided with a recess P55 at its top side and a recess P56 at its underside, and may be a passive rotatable member that passively rotates around the axis AX. The rotator 50 may be a flat-plate member made of a resin, metal and so on, and preferably made of material different than the ring body 40. The recess P55 is shaped like a rectangular viewed from above and is a portion to which a tool such as a flat head screwdriver and so on may be inserted. The recess P56 shaped like a circle viewed from below and for partially receiving the post 105 has an underside 56*p* and a circumferential side 56*q*. The underside 56*p* is a flat surface, and the circumferential side 56*q* is a surface extending along the axis AX. The circumferential side 56*q* gradually ramps radially inwardly and then is coupled with the underside 56*p*. The top view shape of the recess P55 may be changed to be a "+"-like shape with which a Phillips screwdriver may fit.

Satisfied is a relation that the outer thickness W50a<the inner thickness W50b of the rotator 50. Accordingly, a step 52 is provided at the upper outer rim of the rotator 50. The step 52 has a flat surface on which the inner end of the flat plate 31 of the cover 30 is placed. The position of the stacked member of the ring body 40 and the rotator 50 may be restricted between the flat plate 31 of the cover 30 and the bottom part 11 of the can body 10 from below and above. A portion of the rotator 50 having the thickness W50b is thinned by the recess P56 and further partially thinned by the recess P55.

A structure of the male snap 220 will be described with reference to FIGS. 1 and 4. As shown in FIGS. 1 and 4, the male snap 220 has the post 105 which is to be received and to be held by the receiving portion P210 of the female snap 210. As shown in FIG. 1, the post 105 has a neck 105*a* and a head 105*b*. The head 105*b* is sized wider than the neck 105*a*. The outer side of the head 105*b* outwardly bulges in an arc for restricting the draw of the post 105 out of the receiving portion P210 of the female snap 210. The insertion of the post 105 into the receiving portion P210 of the female snap 210 may be allowed by the head 105*b* widening the aperture diameter of the aperture P40 of the ring body 40.

As will be apparent from the following descriptions, a holding force of the receiving portion P210 of the female snap 210 for holding the post 105 of the male snap 220 (hereinafter sometimes simply referred to as a holding force) may be determined in accordance with the relative position of the ring body 40 and the can body 10 in the circumferential direction that is around the receiving portion P210. Accordingly, the above described holding force may be controllable with a simple configuration. The holding force may be controllable not only during the manufacturing but also after the manufacturing, thereby enhancing its usefulness/convenience in a wide variety of fields.

The holding force may be a force required to disengage the engaged female snap 210 and the male snap 220 by applying force to them to separate (decouple) each other. Here, it is named as the holding force as it is a force for maintaining the engaged state. This holding force appears when they are engaged but, of course, may be effective even when they are not engaged. That is, if the holding force is strong, the force for maintaining the engaged state is strong; and greater force for engaging them is required when they are to be engaged, compared with a case where the holding force is weak. In view of above, the holding force may be referred to as an engagement force required to engage/disengage the male snap and the female snap.

As shown in FIGS. 1 and 4, the male snap 220 may be configured by plates 110, 120 shaped by any arbitrary method. As shown in the lower section of FIG. 4, the plate 110 has a base 111 and a post inner wall 112. The base 111 is a part for pressing the fabric 230 and is annularly configured to surround the axis AX. The post inner wall 112 is a tube extending along the axis AX and having open ends at both sides. The post inner wall 112 is a part for penetrating through the fabric 230. The top end of the post inner wall 112 is outwardly curved in an arc and engages with the plate 120. This outwardly curved arc portion 113 may be referred to as a bulge 113.

The plate 120 has a base 121 and a post outer wall 122. The base 121 is a part for pressing the fabric 230 and is annularly configured to surround the axis AX. The post outer wall 122 is a part having an open lower end and a closed top end, and the outer rim of its top end is radially outwardly curved in an arc and engages with the plate 110. This radially outwardly curved arc part may be referred to as a bulge 123. The bulge 113 of the post inner wall 112 engages with the bulge 123 of the post outer wall 122 so that the plate 110 and the plate 120 are mutually locked.

The fabric 230 may be sandwiched between the base 111 and the base 121 from above and from below. The male snap 220 is processed by a press when the fabric 230 is sandwiched between the base 111 and the base 121 so that a plurality of hollows 115 are formed at the base 111 and a plurality of protuberances 125 are formed at the base 121. As a result, the male snap 220 is firmly attached to the fabric 230. As shown in the upper section of FIG. 4, the male snap 220 is processed by a press at six points symmetrically around the axis AX A description will be made about a structure for restricting the range of rotation of the rotator 50 with reference to FIGS. 5 and 6. FIG. 5 illustrates a cross-sectional configuration of the rotator 50 and the can body 10 taken along a dashed line X5-X5 in FIG. 6. FIG. 6 illustrates a cross-sectional configuration of the female snap 210 taken along a dashed line of X6-X6 in FIG. 5. As shown in FIG. 5, the outer side of the rotator 50 is provided with a groove 55 continuously extending within a predetermined range in the circumferential direction. The range of extension of the groove 55 in the circumferential direction is defined by the stop ends 55*a*, 55*b*. The tube 12 of the can body 10 is provided with a stop 12*p* that is positioned within the groove 55 and is expected to bump against the stop ends 55*a*, 55*b* of the groove 55. As shown in FIG. 5, the stop end 55*b* bumps against the stop 12*p*, thereby restricting further clockwise rotation of the rotator 50. The counterclockwise rotation of the rotator 50 may be restricted by the stop end 55*a* bumping against the stop 12*p*. The rotational range of the rotator 50 is thus restricted so that the two stop positions (rotational stop position) for the rotator 50 are arranged, and the holding forces of the receiving portion P210 of the female snap 210 may be determined in relation to the respective stop positions (This feature will be apparent from the following descriptions).

As shown in FIG. 6, the outer side of the ring body 40 is provided with a groove similar to that of the rotator 50. The ring body 40 and the rotator 50 rotate together, thus it may be preferable to restrict the rotational range of the ring body 40 similar to the rotator 50. It should be noted that the stop 12*p* may not necessarily be a part of the tube 12 of the can body 10 itself and may be another member. Various approaches may be taken for restricting the rotational range of the ring body 40 and the rotator 50. As described above, the can body 10 may be utilized to restrict the rotational range of the ring body 40 and the rotator 50. Other than that, the cover 30 may be utilized to restrict the rotational range of the rotator 50.

A description will be made, with reference to FIGS. 7 and 8, on how to regulate the holding force of the receiving portion P210 for holding the post 105 in accordance with the relative position of the ring body 40 and the can body 10 in the circumferential direction. FIGS. 7 and 8 are transverse cross-sectional views of the ring body 40, the can body 10, and the attachment body 20 taken along a dashed line X7-X7 in FIG. 1. Also, a description will be made with reference to FIGS. 9-11.

As shown in FIG. 7, the ring body 40 has different diameters R40, R41 where the diameter R40>the diameter R41 is satisfied. A portion corresponding to the diameter R40 may be named as a contacted portion 40*m* (a pressed portion for purpose of explanation of the embodiments). The pressed portion 40*m* includes projections 40*m*1, 40*m*2 projecting radially outwardly as shown in FIG. 7. The projections 40*m*1, 40*m*2 are provided at an interval of 180 degrees in the circumferential direction and which are respectively projecting in an opposite direction.

As shown in FIG. 7, the can body 10 has different inside diameters R10, R11 where the inside diameter R10<the inside diameter R11 is satisfied. A portion corresponding to the inside diameter R10 may be called as a contact portion 10*m* (a press portion for purpose of explanation of the embodiments). The press portion 10*m* includes projections 10*m*1, 10*m*2 projecting radially inwardly, as shown in FIG. 7. The projections 10*m*1, 10*m*2 are radially inwardly projections made by the tube 12 being radially inwardly depressed. The projections 10*m*1, 10*m*2 are provided at an interval of 180 degrees in the circumferential direction.

In FIG. 7, the pressed portion 40*m* of the ring body 40 and the press portion 10*m* of the can body 10 are NOT facing each other, not restricting the radial outward transformation of the ring body 40. This condition may be referred to as "a weak snap state" for purpose of explanation. In contrast, in FIG. 8, the pressed portion 40*m* of the ring body 40 and the press portion 10*m* of the can body 10 are facing each other, restricting the radial outward transformation of the ring body 40. This condition may be referred to as "a strong snap state" for purpose of explanation. Under the "strong snap state", it is not easy to insert and draw compared to the "weak snap state". The respective conditions shown in FIGS. 7 and 8 correspond to the clockwise stop position of the rotator 50 and the counterclockwise stop position of the rotator 50 (See FIG. 5 and the relevant explanations). More specifically, the diameter of the aperture P40 is less than the diameter of the head 105*b* and thus, when engaging the post 105 with the female snap 210, the post 105 forces the ring body 40 to elastically deform so as to expand the diameter of the aperture P40. After the head 105*b* has passed through the aperture P40, the ring body 40 elastically recovers and the aperture P40 recovers to its initial diameter, and thus it engages with the neck 105*a*. Preferably, the diameter of the neck 105*a* may be less than the diameter of the head 105*b* and may be less than the minimum diameter of the aperture P40. Under the "strong snap state", the expansion of the aperture P40 diameter is suppressed, making it difficult for the head 105*b* to pass through the aperture P40 compared to the "weak snap state".

It will be arbitrary if the pressed portion 40*m* of the ring body 40 touches the press portion 10*m* of the can body 10 when the pressed portion 40*m* and the press portion 10*m* face each other. If they are in contact one another, the aperture shape of the ring body 40 may be transformed from a perfect circle to an oval for example, resulting in much greater holding force as the length of the minor axis of the oval is less than the diameter of the perfect circle. When the holding force is at higher level, the draw of the male snap 220 out of the female snap 210 may be further restricted. When the holding force is at lower level, the draw of the male snap 220 out of the female snap 210 may NOT be further restricted. It may be apparent for the skilled person in the art to understand that the weak snap state corresponds to an unlocked state and the strong snap state corresponds to a locked state.

Under the exemplary "weak snap state" shown in FIG. 7, the radial outward transformation of the ring body 40 is not restricted and thus it may be not difficult to insert the post 105 of the male snap 220 into the receiving portion P210 of the female snap 210 or to draw the post 105 of the male snap 220 out of the receiving portion P210 of the female snap 210.

As shown in FIGS. 9 and 10, when the head 105*b* of the post 105 being pressed into the aperture P40 of the ring body 40, the ring body 40 transforms radially outwardly and therefore the aperture diameter of the aperture P40 expands from its initial aperture diameter. A clearance is provided between the pressed portion 40*m* of the ring body 40 and the inner side of the tube 12 of the can body 10, allowing the transformation of the ring body 40 and securing the greater extent of expansion of the aperture P40 allowed by the can body 10. The same explanation holds true for a case where the head 105*b* of the post 105 is to be pressed into the aperture P40 of the ring body 40 from above, i.e. when separating the female snap 210 and the male snap 220. The ring body 40 may get back to its initial shape when it is released from the radian and outward pressing by the post 105. The aperture diameter of the aperture P40 may recover to its initial aperture diameter from the expanded aperture diameter.

Under the exemplary "strong snap state" shown in FIG. 8, the pressed portion 40*m* of the ring body 40 and the press portion 10*m* of the can body 10 are facing, and the transformation of the ring body 40 is restricted. That is, when comparing with the "weak snap state", the degree of the transformation of the ring body 40 allowed by the can body 10 is less and the extent of the expansion of the aperture P40 of the ring body 40 allowed by the can body 10 is less. Therefore, it may be not easier to draw the post 105 out of the receiving portion P210 of the female snap 210. Similarly, it may be not easier to insert the post 105 into the receiving portion P210 of the female snap 210. It should be noted that the easiness may be a matter of degree and may not indicate impossible.

As shown in FIG. 11, when the head 105*b* of the post 105 is to be pressed into the aperture P40 of the ring body 40 from above, the pressed portion 40*m* of the ring body 40 are to be moved radially outwardly but are to be pushed back radially inwardly by the press portion 10*m* of the can body 10, resulting in that the radial outward transformation of the ring body 40 is suppressed and the expansion of the aperture diameter of the aperture P40 of the ring body 40 is suppressed. In this case, the maximum aperture width of the aperture P40 allowed by the can body 10 is small. The same explanation holds true for a case where the head 105*b* of the post 105 is pressed into the aperture P40 of the ring body 40 from below.

In this embodiment, as will be apparent from above explanations, in accordance with the relative position of the pressed portion 40*m* of the ring body 40 and the press portion 10*m* of the can body 100 in the circumferential direction, the extent of the expansion of the aperture P40 of the ring body 40 allowed by the can body 10 and the holding force of the receiving portion P210 of the female snap 210 for holding the post 105 of the male snap 220 are adjustable. Various approaches for suppressing the transformation of the ring body 40 may be employed. However, the tube 12 having the peripheral wall surrounding the ring body 40 may be suitably employed as in this embodiment so that the restriction of the transformation of the ring body 40 may be accomplished with a simple configuration.

In this embodiment, as will be apparent from the above explanations, the above-described holding force may be adjusted at any time. In particular, the ring body 40 may be rotatable by supplying a torque to the rotator 50 even after the female snap 210 has been manufactured. For example, the ring body 40 positioned at the angular position shown in FIG. 7 may be rotated to the angular position shown in FIG. 8. Doing so would change the status from the weak snap status to the strong snap status. Therefore, after engaging the female snap 210 and the male snap 220 in the weak snap state, changing it to the strong snap state would prohibit the easier draw-out. This may be useful for an anticrime measure, this is just an example though. It should be noted that the holding force of the receiving portion P210 of the female snap 210 for holding the post 105 of the male snap 220 may not necessarily be two staged and may be staged more than two.

The method of manufacturing the snap button 200 will be apparent for the skilled person in the art in view of the above descriptions. As a supplemental description, the female snap 210 may be manufactured by the following steps, for example. First, opening a hole at the fabric 230 and inserting the attachment body 20 into the hole. Next, mounting the can body 10 onto the attachment body 20; stacking the ring body 40 and the rotator 50 in the can body 10; closing the can body 10 from above by the cover 30; and bending the lower end of the outer skirt 32 of the cover 30. The male snap may be manufactured by the following steps, for example. Opening a hole at the fabric 230, and inserting thereto the plate 110 shaped as shown in FIG. 1. Next, engaging the plate 120 shaped as shown in FIG. 1 with the plate 110. After that, fixing the male snap 220 firmly against the fabric 230 by the above-described punch process. The manufacturing step for the snap button 200 may largely depend on the machines and the tools to be used for manufacturing.

2nd Embodiment

Figure 12:
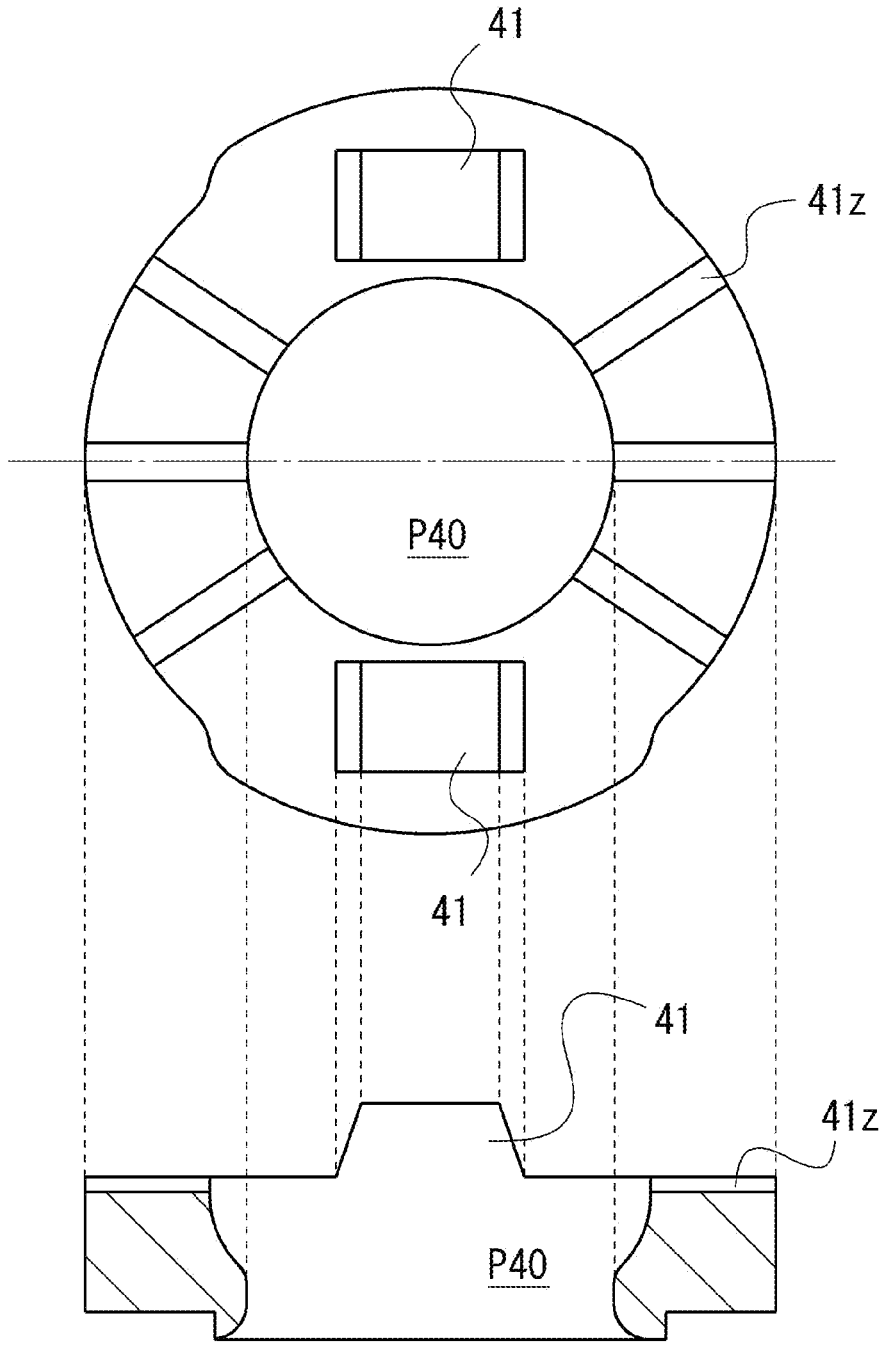
FIG. 12 illustrates schematic top and cross-sectional views of a ring body in accordance with a second embodiment of the invention.

Second embodiment will be described with reference to FIG. 12. In this embodiment, unlike the above embodiment, the ring body 40 may be provided with symmetrically arranged 6 pieces of radially extending grooves 41*z* at its main surface (top surface or undersurface). This may facilitate the transformation of the ring body 40 and promotes the increase of the holding force. Specifically, when the pressed portion 40*m* is pressed radially inwardly by the press portion 10*m* of the can body 10, the grooves 41*z* at the main surface of the ring body 40 may facilitate the deformation of the ring body 40 so that the aperture shape of the aperture P40 of the ring body 40 may be easily transformed. As one example, the aperture shape of the aperture P40 may transform from a perfect circle to an oval. Accordingly, it may be possible to increase the holding force of the receiving portion P210 of the female snap 210 for holding the post 105 of the male snap 220 and to secure the wider range of the holding force. It should be noted that the similar effects may be achievable in this embodiment as in the first embodiment.

3rd Embodiment

Third embodiment will be described with reference to FIG. 13. In this embodiment, unlike the above embodiments, the ring body 40 may have a diameter R42 which is an intermediate value between the diameter R40 and the diameter R41; and the degree of the height of the pressed portion of the ring body 40 may vary in a stepwise manner in the circumferential direction. In such a case, the holding force of the receiving portion P210 of the female snap 210 for holding the post 105 of the male snap 220 is set to include 3 stages, thereby realizing fine regulation of the holding force. It should be noted that number of stages allocated to the holding force may not be limited to 3 stages and may be more than 3 stages. It may be possible to achieve the equivalent effects in this embodiment as in the above embodiments.

Figure 13:
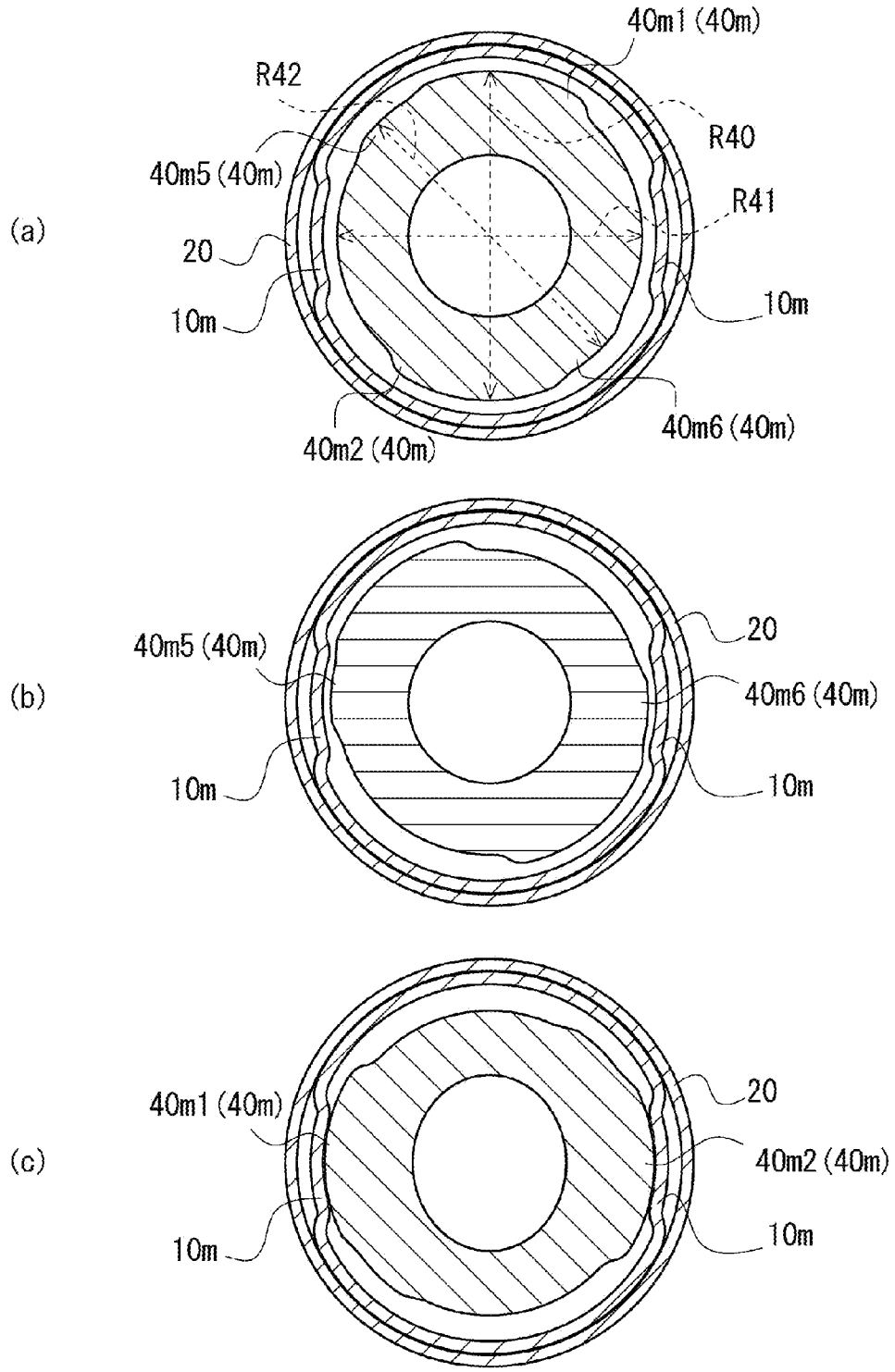
FIG. 13 is a schematic transverse cross-sectional view illustrating a structure of a female snap and a rotation of a ring body in accordance with a third embodiment of the invention.

As shown in FIG. 13 (*a*), the ring body 40 additionally includes a first contacted portion 40*m*5, 40*m*5 (a first pressed portion for the explanation of the embodiments) corresponding to the diameter R42. When the first pressed portion 40*m*5, 40*m*6 of the ring body 40 and a contact portion 10*m* (a press portion in the explanation for the embodiments) of the can body 10 are facing as shown in FIG. 13 (*b*), the radial outward transformation of the ring body 40 may be slightly restricted. That is, in FIG. 13 (*b*), when the ring body 40 is to be radially outwardly transformed, the ring body 40 is easily transformed for the amount of the clearance between the outer rim of the ring body 40 and the press portion 10*m* at first, and then after being contacted by the press portion 10*m* its further transformation may be suppressed, resulting in greater holding force than the state of FIG. 13(*a*). As shown in FIG. 13 (*c*), when second contacted portions 40*m*1, 40*m*2 (second pressed portions for purpose of explanation of the embodiments) corresponding to the diameter R40 and the press portion 10*m* of the can body are facing and contacting, the aperture shape of the aperture P40 of the ring body 40 may change from a perfect circle to an oval by the pressing force, resulting in much smaller minimum value of the aperture diameter of the aperture P40 of the ring body 40. In FIG. 13(*c*), the ring body 40 is sandwiched by the can body 10 and thus locked, and therefore its state may be perceivable by a manipulating person who is rotating the rotator 50.

FIG. 13 (*a*) illustrates a state where the above-described holding force is minimum. FIG. 13 (*b*) illustrates a state where the above-described holding force is an intermediate value between the states of FIG. 13(*a*) and FIG. 13(*c*). FIG. 13(*c*) illustrates a state where the above-described holding force is maximum. Providing such a multi-staged holding force may improve the usability of the snap button and may possibly widen its application.

4th Embodiment

Figure 14:
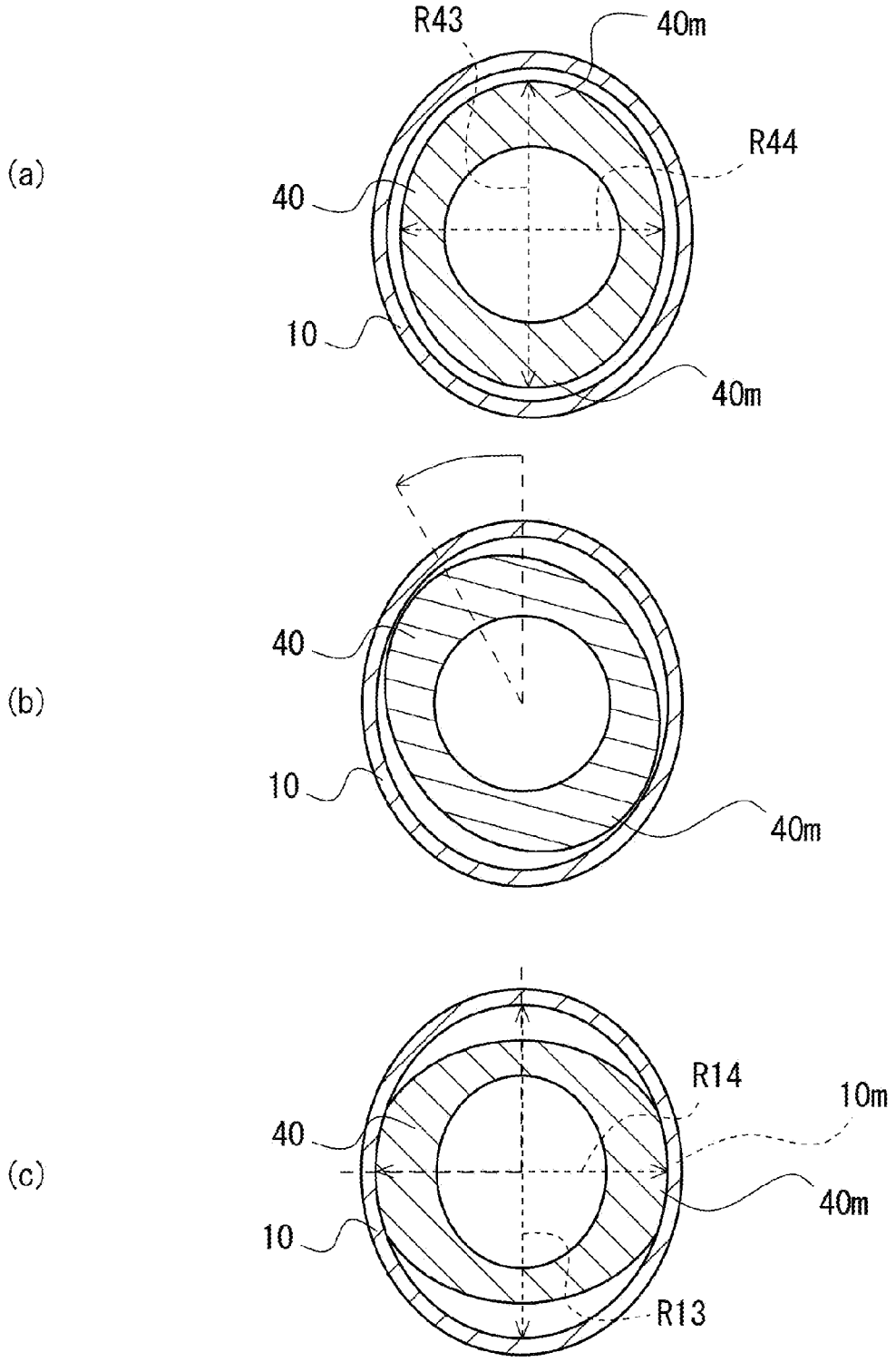
FIG. 14 is a schematic transverse cross-sectional view illustrating a structure of a female snap and rotation of a ring body in accordance with a fourth embodiment of the invention.

Forth embodiment will be described with reference to FIG. 14. In this embodiment, unlike the above embodiments, the ring body 40 may be shaped like an oval and the can body 10 (the tube 12) may be also shaped like an oval similarly. When the ring body 40 is rotated in counterclockwise direction by 30 degrees, 90 degrees in a stepwise manner as shown in FIG. 14 (*a*) to (*c*), the ring body which was NOT in contact with the can body 10 as shown in FIG. 14(*a*) is made to be in contact with the can body 10 (the tube 12) as shown in FIG. 14(*b*) and then it is sandwiched by the can body 10 (the tube 12) as shown in FIG. 14(*c*). FIG. 14 (*a*) to (*c*) correspond to FIG. 13 (*a*) to (*c*). Even with such a manner for restricting the radial outward transformation of the ring body 40, the similar effects may be achievable as in the above embodiments.

As shown in FIG. 14(*a*), the ring body 40 has different diameters R43 and diameter R44, where the diameter R43>the diameter R44 is satisfied. The diameter R43 is the maximum value of the diameter of the ring body 40 and the diameter R44 is the minimum value of the diameter of the ring body 40. The ring body 40 has a pressed portion 40*m* corresponding to the diameter R43. It should be noted that, as the ring body 40 and the can body 10 are shaped in oval in this embodiment, the pressed portion 40*m* may be located at any point other than the diameter R43 which may contact the inner side of the can body 10 and has a diameter greater than the diameter R44.

The can body 10 (the tube 12) has different inside diameters R13 and R14 as shown in FIG. 14(*c*), where the inside diameter R13>the inside diameter R14 is satisfied. The inside diameter R13 is the maximum value of the inside diameter of the can body 10 (the tube 12), and the inside diameter R14 is the minimum value of the inside diameter of the can body 10 (the tube 12). The can body 10 has a press portion 10*m* corresponding to the inside diameter R14. As shown in FIG. 14(*c*), the outer side of the ring body 40 is sandwiched by the inner side of the tube 12. The pressed portions 40*m* of the ring body 40 are pressed by the press portions 10*m* of the can body 10.

5th Embodiment

Fifth embodiment will be described with reference to FIGS. 15-19. In this embodiment, unlike the above embodiments, a single member of a ring rotator 70 may be employed which is formed by unifying the functionality and the structure of the ring body 40 and the rotator 50. In this configuration, the thickness of the female snap 210 may be reduced and the number of components may be reduced, in addition to the similar effects with the above-described embodiments. Further, in this embodiment, differently structured female snap 210 and the male snap 220 may be employed. Even so, similar effects may be achievable as in the above-described embodiments.

Figure 15:
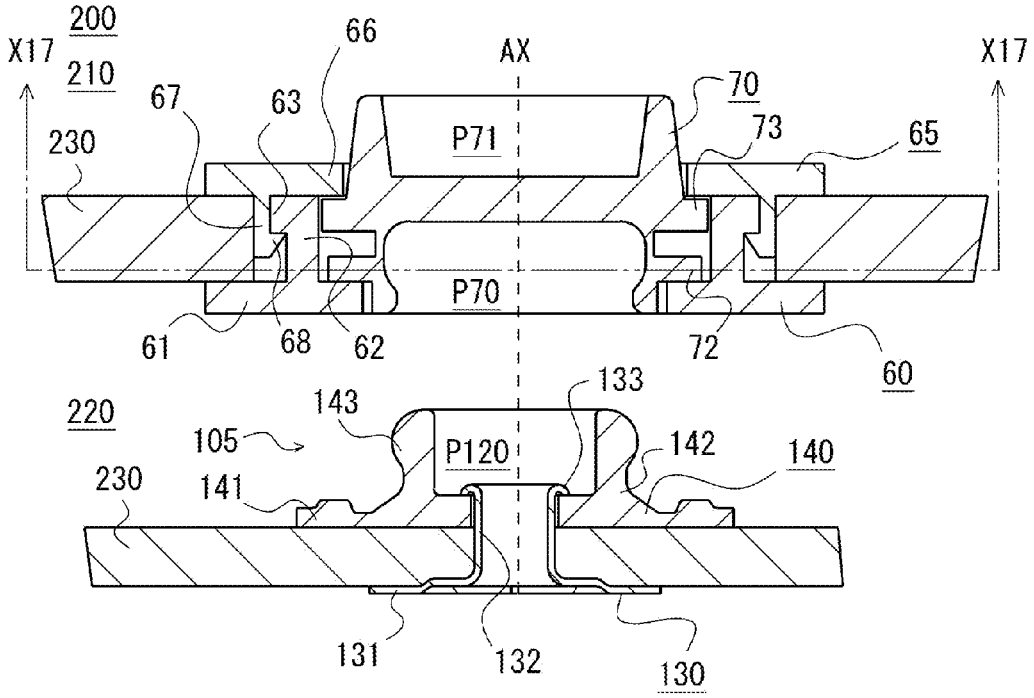
FIG. 15 is a schematic cross-sectional view of a snap button in accordance with a fifth embodiment of the invention.

As shown in FIG. 15, the female snap 210 has a bottom frame 60 (a second member), a top frame 65, and a ring rotator 70 (a first member). Similar to the case described in the first embodiment, the bottom frame 60 and the top frame 65 form a frame member of the female snap 210, and the ring rotator 70 is housed in that frame member. The component signed as 60 may be named as an inner frame and the component signed as 65 may be named as an outer frame, in view of the position of engagement tubes 62, 67 of the two sub-frames in FIG. 15.

As shown in FIG. 15, the bottom frame 60 has a base 61, and an engagement tube 62. The engagement tube 62 forms a peripheral wall surrounding the bottom half of the ring rotator 70. The top end of the engagement tube 62 is provided with a flange 63 projecting radially outwardly. The ring rotator 70 is mounted on the inner part of the base 61. The fabric is provided on the outer part of the base 61. As shown in FIG. 15, the top frame 65 has a base 66 and the engagement tube 67. The engagement tube 67 forms the peripheral wall surrounding the bottom half of the ring rotator 70 together with the engagement tube 62 of the bottom frame 60. The lower end of the engagement tube 67 is provided with a hook 68 projecting radially inwardly. The ring rotator 70 is provided below the inner part of the base 66. The fabric 230 is provided below the outer part of the base 61. The engagement of the flange 63 and the hook 68 may secure the engagement of the top and bottom frames 60, 65.

The female snap 210 may be assembled as follows: placing the bottom frame 60 at a hole provided at the fabric 230; placing the ring rotator 70 in the bottom frame 60; and then fitting the top frame 65 with the bottom frame 60. Alternatively, the bottom frame 60 may be placed in a hole at the fabric 230; the bottom frame 60 is fitted against the top frame 65; and then the ring rotator 70 is positioned in a space defined by the bottom frame 60 and the top frame 65.

In FIG. 15, the fabric 230 is sandwiched by the bottom frame 60 and the top frame 65 from above and from below, thereby fixing the female snap 210 with the fabric 230. In FIG. 15, the position of the ring rotator 70 housed in the bottom frame 60 is restricted by the top frame 65, thereby carrying the ring rotator 70 rotatable around the axis AX between the bottom frame 60 and the top frame 65. The fabric 230 to which the female member 210 is attached may be a thick member such as a foot rest mat provided near a seating of a car, for example.

The ring rotator 70 has a receiving portion P70 for receiving the post 105 of the male snap 220 at its underside and a recess P71 at its top side with which a tool such as a flat head screwdriver and so on is fitted. The outer side of the ring rotator 70 is provided with rings 72 and 73 equally projecting radially outwardly. The ring 72 corresponds to the ring body described in the first embodiment. The above-described holding force may be regulated in accordance with the relative position of the ring 72 and the bottom frame 60 in the circumferential direction. The ring 73 corresponds to the portion of the rotator 50 having the outer thickness W50a described in the first embodiment, and is positioned below the top frame 65 and is restricted to move upward by the top frame 65.

The male snap 220 has a post 105 and is fixed to the fabric 230 similar to the first embodiment. Unlike the first embodiment, the male snap 220 is configured from an attachment body 130 and a post 140. The post 140 is secured to the fabric 230 by the attachment body 130.

The attachment body 130 has a base 131 and a tube 132. The base 131 is an annular part surrounding the axis AX and presses the fabric 230 from below. The tube 132 is a hollow cylinder provided at the center of the base 131 and penetrates the fabric 230. The top end of the tube 132 is bended after it has penetrated the fabric 230, thereby the curve 133 curving radially outwardly is provided at the top end of the tube 132. The post 140 is pressed toward the fabric 230 by the curve 133, thereby the fabric 230 is nicely sandwiched by the attachment body 130 and the post 140 from above and from below.

The post 140 has a base 141 and a cylinder 142. The base 141 is an annular part surrounding the axis AX and presses the fabric 230 from above. The cylinder 142 is a hollow cylindrical portion positioned at the center of the base 141 and is to be received by the receiving portion P70 of the female snap 210. The top end of the cylinder 142 is provided with a bulge 143 which bulges radially outwardly in an arc from the outer side. The bulge 143 corresponds to the head 105*b* of the post 105 in the first embodiment. A part NOT bulging radially outwardly from the outer side of the cylinder 142 may correspond to the neck 105*a* of the post 105 in the first embodiment.

Figure 16:
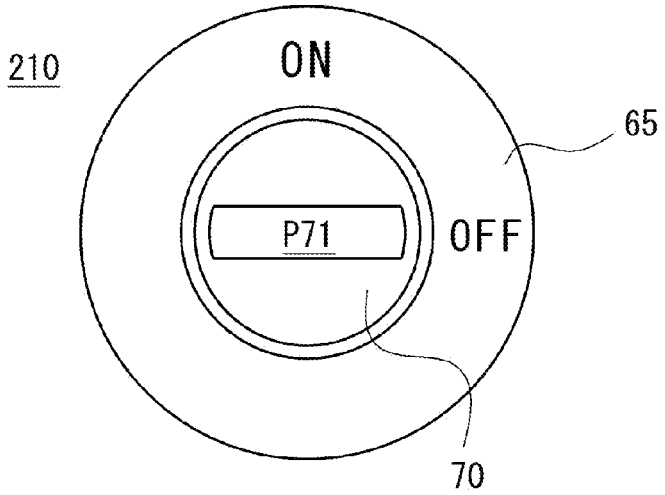
FIG. 16 is a schematic top view of a snap button in accordance with a fifth embodiment of the invention.

As shown in FIG. 16, the top side of the base 66 of the top frame 65 is provided with an indicator such as "ON", "OFF" by means of any method such as printing/engraving and so on, thereby it may be possible to understand externally the above-described holding force immediately. It should be noted that the indicator provided at the top side of the base 66 of the top frame 65 should not be limited to a letter such as an alphabet and so on, but may be a figure or an uneven structure and so on. The indicator may be formed on the top frame 65 by any means of molding, laser marking, thermal processing, coloring and so on.

Figure 17:
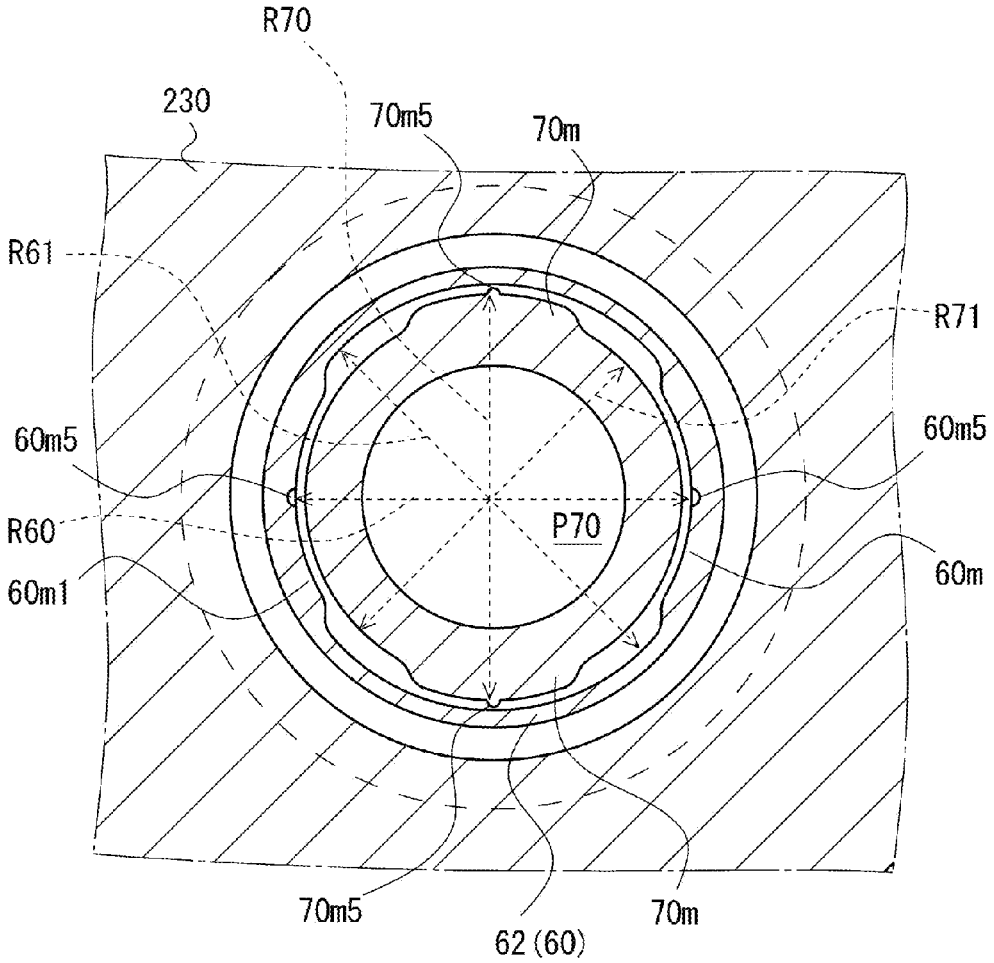
FIG. 17 is a schematic transverse cross-sectional view of a female snap taken along a dashed line X17-X17 in FIG. 15.

With reference to FIG. 17, an explanation will made on how the holding force by the receiving portion P70 for the post 105 is regulated in accordance with the relative position of the ring rotator 70 and the bottom frame 60 in the circumference direction. FIG. 17 is a cross section of the ring rotator 70, the bottom frame 60, and the fabric 230 taken along X17-X17 in FIG. 15.

The ring rotator 70 has different diameters R70, R71 similarly with the first embodiment, where the diameter R70>the diameter R71 is satisfied. A portion corresponding to the diameter R70 may be called as a pressed portion 70*m*. The pressed portion 70*m* includes projections 70*m*1, 70*m*2 projecting radially outwardly, as shown in FIG. 17.

The engagement tube 62 of the bottom frame 60 has different inside diameters R60 and R61, where the inside diameter R60<the inside diameter R61 is satisfied. A portion corresponding to the inner diameter R60 may be referred to as a press portion 60*m*. The press portion 60*m* includes projections 60*m*1, 60*m*2 projecting radially outwardly as shown in FIG. 17. The projections 60*m*1, 60*m*2 are formed by the inner side of the engagement tube 62 bulging radially inwardly.

In FIG. 17, the pressed portion 70*m* of the ring rotator 70 and the press portion 60*m* of the bottom frame 60 are not facing, and thus it is under the weak snap state. On the other hand, similar to the case of FIG. 8 in the first embodiment, it is possible to switch to the strong snap state by arranging the pressed portion 40*m* of the ring rotator 70 and the press portion 60*m* of the bottom frame 60 to face each other.

As shown in FIG. 17, the protuberance 70*m*5 further projecting radially outwardly is provided at the center in the circumferential direction of the pressed portion 70*m* of the ring body 70. On the other hand, a notch 60*m*5 depressed radially outwardly is provided at the center in the circumferential direction of the press portion 60*m* of the engagement tube 62 of the bottom frame 60. The protuberance 70*m*5 fits in the notch 60*m*5 so that a manipulating person may feel a locked sense. By increasing the degree of the fitting, the rotation of the ring rotator 70 may be further suppressed.

Figure 18:
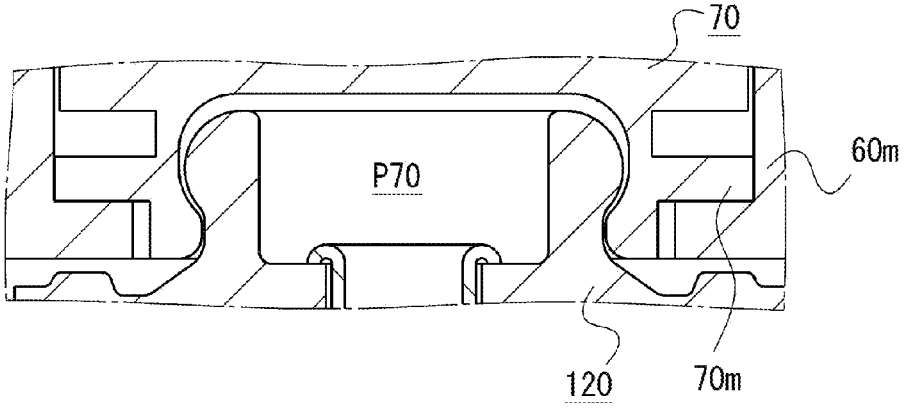
FIG. 18 is a schematic cross-sectional view of a snap button in a strong-snap state in accordance with a fifth embodiment of the invention.
Figure 19:
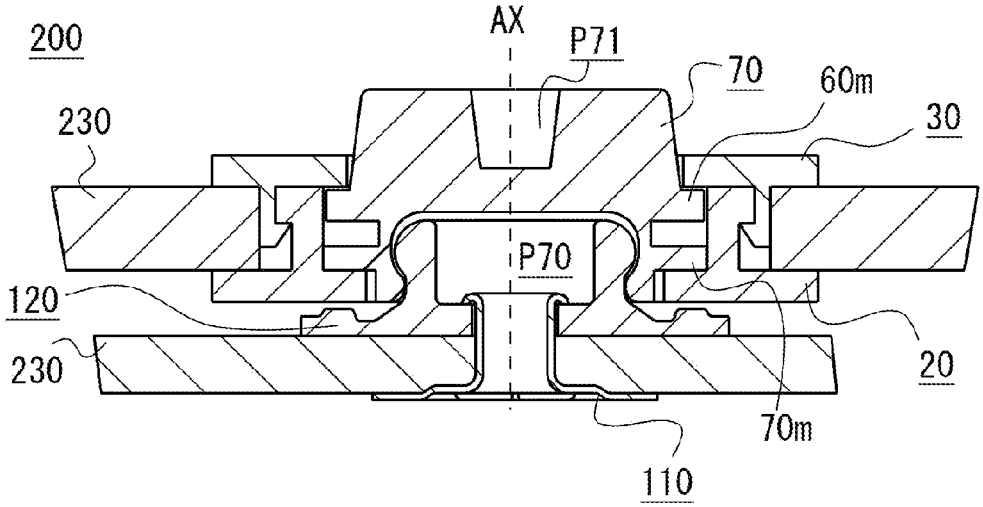
FIG. 19 is a schematic partially expanded cross-sectional view of a snap button in a strong-snap state in accordance with a fifth embodiment of the invention.

FIGS. 18 and 19 illustrate a condition where the ring rotator 70 has been locked by the bottom frame 60 as described above, after the post 105 of the male snap 220 has been inserted to the receiving portion P70 of the female snap 210. In FIGS. 18 and 19, the pressed portion 70*m* of the ring rotator 70 and the press portion 60*m* of the engagement tube 62 of the bottom frame 60 are facing, thus the transformation of the ring rotator 70 is restricted. Therefore, it may be not easy to draw the post 105 out of the receiving portion P70 of the female snap 210. Similarly, it may be not easy to insert the post 105 into the receiving portion P70 of the female snap 210. Even trying to draw the post 105 out of the receiving portion P70 of the ring rotator 70, the pressed portion 70*m* of the ring rotator 70 may be radially inwardly pressed by the press portion 60*m* of the engagement tube 62, thus the radial outward transformation of the ring rotator 70 may be suppressed.

6th Embodiment

Sixth embodiment will be described with reference to FIG. 20 and FIG. 21. In the above-described embodiments, the press portion is provided at the stationary member (the can body 10 in FIG. 1; the bottom frame 60 in FIG. 15), and the pressed portion is provided at the rotator (the ring body 40 in FIG. 1; the ring rotator 70 in FIG. 15). In contrast, in this embodiment, the press portion is provided at the rotator and the pressed portion is provided at the stationary member. Even in this case, similar effects may be achievable as in the above embodiments.

Figure 20:
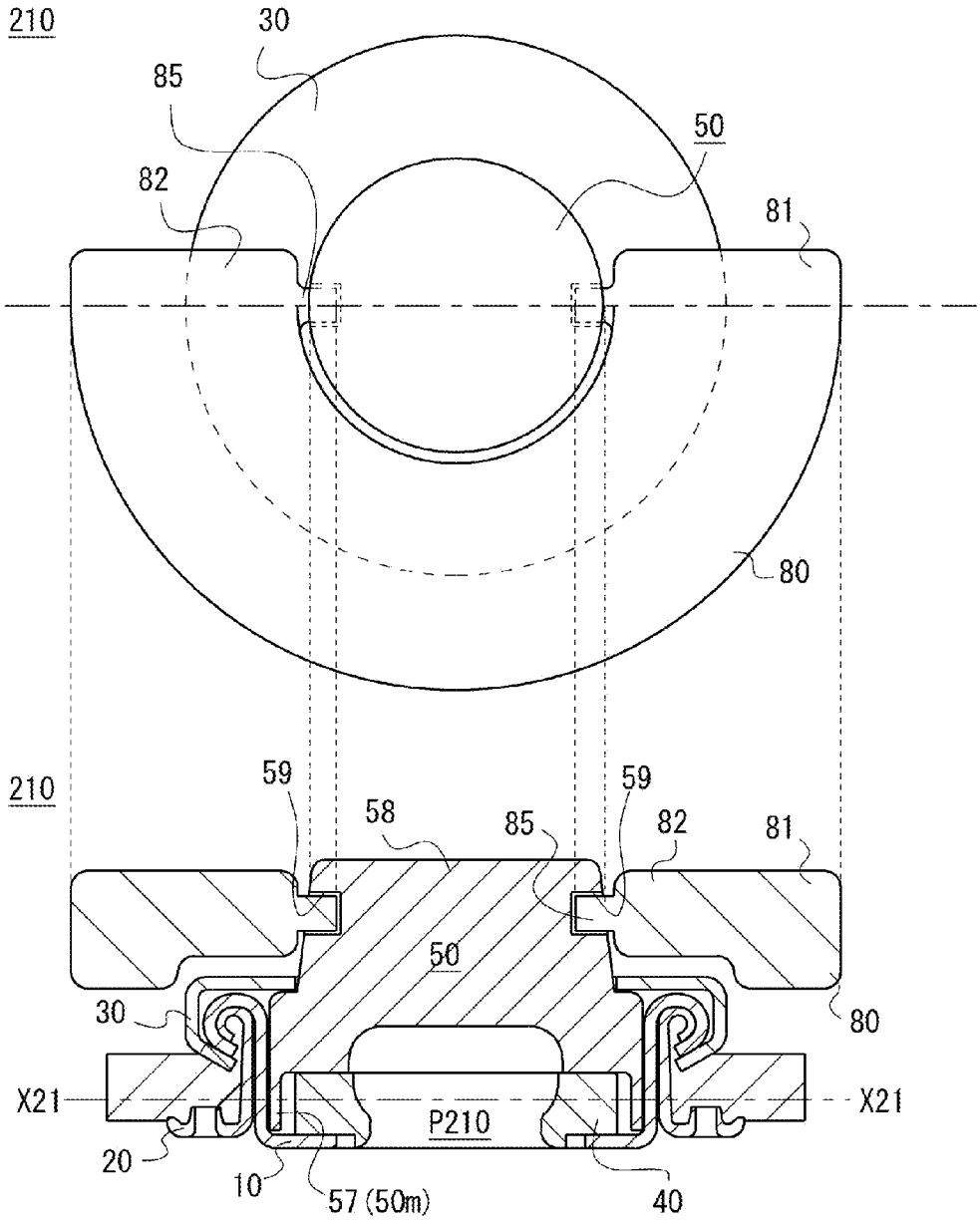
FIG. 20 illustrates schematic top and cross-sectional views of a snap button in accordance with a sixth embodiment of the invention.
Figure 21:
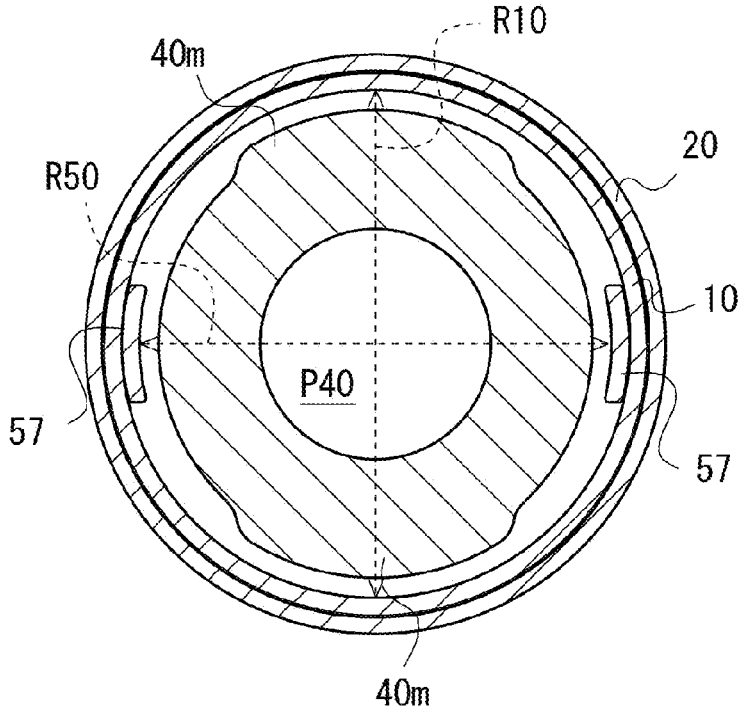
FIG. 21 is a schematic transverse cross-sectional view of a female snap taken along a dashed line X21-X21 in FIG. 20, illustrating a rotation of a rotator.
Figure 21:
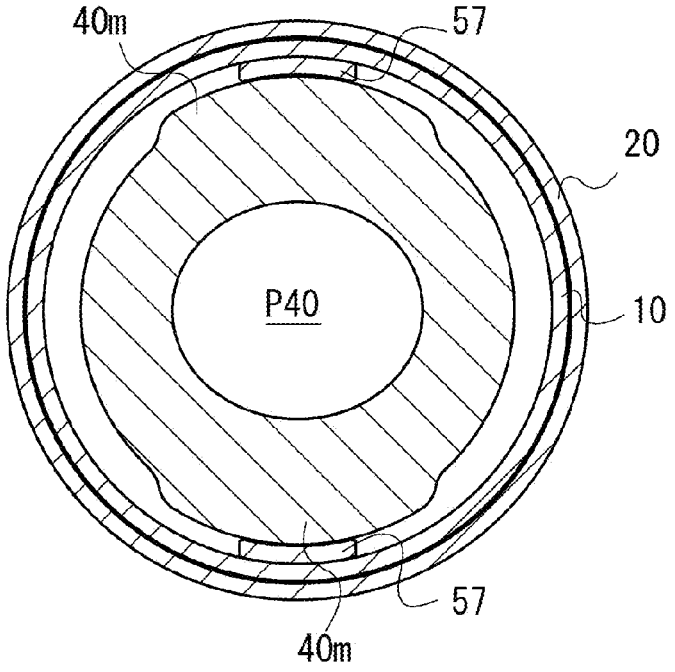

FIG. 20 depicts a top and cross section of the female snap 210. As shown in the lower section of FIG. 20, the rotator (a second member) 50 is provided on the ring body 40. Unlike the first embodiment, the rotator 50 may have a pair of contact legs 57 (referred to as press legs in this explanation) which are provided next to the outer side of the ring body 40. The press leg 57 is a part projecting downward from the outer bottom rim of the rotator 50. The pair of the press legs 57 is provided at an interval of 180 degrees in the circumferential direction as shown in FIG. 21. The press leg 57 acts similar to the above-described press portion 50*m*.

As shown in FIG. 20, the upper portion 58 of the rotator 50 is provided with a gripper 80. The gripper 80 is to be gripped and rotated in clockwise or counterclockwise direction so that the rotator 50 will be rotated around the axis AX. In this example, a torque received by the rotator 50 is not transferred to the ring body 40. Various approaches may be taken to fix the ring body 40 to the can body 10.

As shown in FIG. 20, the upper portion 58 of the rotator 50 bulges upward in a projected shape over the cover 30. The outer side of the upper portion 58 of the rotator 50 is provided with a pair of recesses 59. The grip 80 has a half cut shape of a ring and the inner sides around the cut portions are provided with a pair of protuberances 85 projecting radially inwardly. The protuberance 85 of the grip 80 fits in the recess 59 of the rotator 50 so that the grip 80 is attached to the rotator 50. A thick portion 81 and a thin portion 82 are provided at the body of the grip 80, and the boundary between the thick portion 81 and the thin portion 82 is set along the line of the outer rim of the cover 30 (See the upper section in FIG. 20). Accordingly, when the grip 80 is pushed down from an upright state to a lodged state, the grip 80 may be weakly locked by the cover 30.

Regulating the above-described holding force will be explained with reference to FIG. 21. In FIG. 21(*a*), the pressed portion 40*m* of the ring body 40 and the press leg 57 of the rotator 50 are not facing, therefore the radial outward transformation of the ring body 40 is not restricted. In contrast, in FIG. 21(*b*), the pressed portion 40*m* of the ring body 4 and the press leg 57 of the rotator 50 are facing, therefore the radial outward transformation of the ring body 40 is restricted. It should be noted that, if an inside diameter R10 of the can body 10 and the diameter R50 between the press legs 57 are set as shown in FIG. 21(*a*), R10>R50 is satisfied.

7th Embodiment

Seventh embodiment will be described with reference to FIGS. 22-28. In the above-described embodiments, it may be possible to suitably change the relative position of the press portion and the pressed portion in the circumferential direction. In contrast, in this embodiment, the relative position of the press portion and the pressed portion in the circumferential direction are preset/prefixed when manufacturing the female snap. A strong snap type in which the radial outward transformation of the ring body is restricted and a weak snap type in which the radial outward transformation of the ring body is not restricted are individually produced. Even in this case, similar effects may be achievable with the above-described embodiments except for the loss of the function of regulation between strong and weak after the manufacturing. In this embodiment, it can be said that the above-described strong-weak regulation function is replaced by the selection of the snap type. In the strong snap type, much stronger force is required to coupled/decouple the female snap 21 and the male snap 220. In this embodiment, a differently structured female snap 210 is employed than the above-described embodiments. Even in such a case, the advantages described in the above embodiments may not lose.

Figure 22:
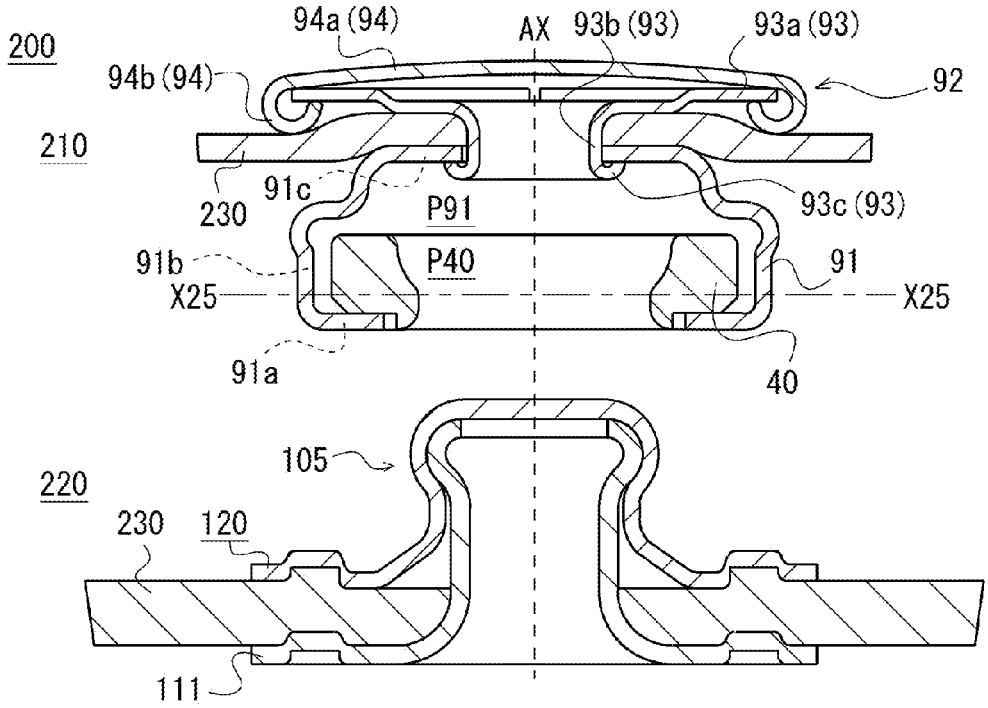
FIG. 22 is a schematic cross-sectional view of a snap button before being coupled in accordance with a seventh embodiment of the invention.
Figure 23:
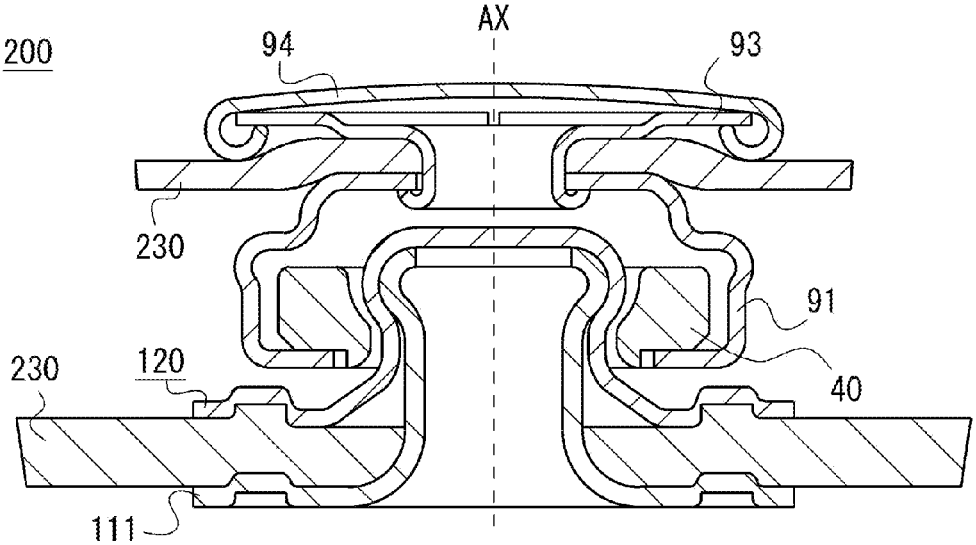
FIG. 23 is a schematic cross-sectional view of a snap button before being coupled in accordance with a seventh embodiment of the invention.

The configuration of the female snap 210 will be described with reference to FIGS. 22 and 23. As shown in FIG. 22, the female snap 210 has a holder 91 (a second member) and an attachment member 92. The holder 91 may be a member shaped from a tube member by any arbitrary method, and has a bottom part 91, a tube 91*b*, and a press part 91*c*. A rectangular opening is provided at the bottom part 91*a*, and the ring body 40 is suitably fixed on the periphery of that opening. The tube 91*b* is a part extending along the axis AX. The press part 91*c* extends radially inwardly from the top end of the tube 91*b* and has an opening on the axis AX. The press part 91*c* contacts the underside of the fabric 230 and presses it toward above, when it is attached to the fabric. The holder 91 has a receiving portion P91 for receiving the post 105 of the male snap 220, and the ring body 40 is position close to the bottom part 91*a* within the receiving portion P91.

As shown in FIG. 22, the attachment member 92 has an attachment plate 93 and a decorative plate 94. The attachment plate 93 has a base 93*a* and a shank 93*b*. The base 93*a* is an annular portion surrounding the axis AX, and has an inner and outer peripheries which are at different height in the direction of the axis AX. The fabric 230 is positioned on the inner periphery of the base 93*a* that is for pressing the fabric 230 downward. The shank 93*b* extends along the axis AX and includes a cylinder for penetrating the fabric 230. The lower end of the shank 93*b* is curved radially outwardly, thereby the curve 93*c* is provided at the lower end of the shank 93*b*. The curve 93*c* and the inner end of the press portion 91*c* engages so that the holder 91 and the attachment member 92 are coupled in up and down direction, the fabric 230 is sandwiched therebetween, and the female snap 210 is fixed to the fabric 230.

As shown in FIG. 22, the decorative plate 94 has a blanket 94*a* and a curve 94*b*. The blanket 94*a* is a disk-like portion provided over the attachment plate 93 so that the through-hole of the shank 93*b* of the attachment plate 93 is covered. The outer edge of the attachment plate 93 is curved downward, and radially inwardly to line a circle so that the curve 94*b* is shaped. The outer edge of the base 93*a* is sandwiched between the end of the curve 94*b* and the underside of the blanket 94*a* so that the decorative plate 94 is attached to the attachment plate 93. Similar to above-described embodiments, the female snap 210 and the male snap 220 couples in up and down direction as shown in FIG. 23.

Figure 24:
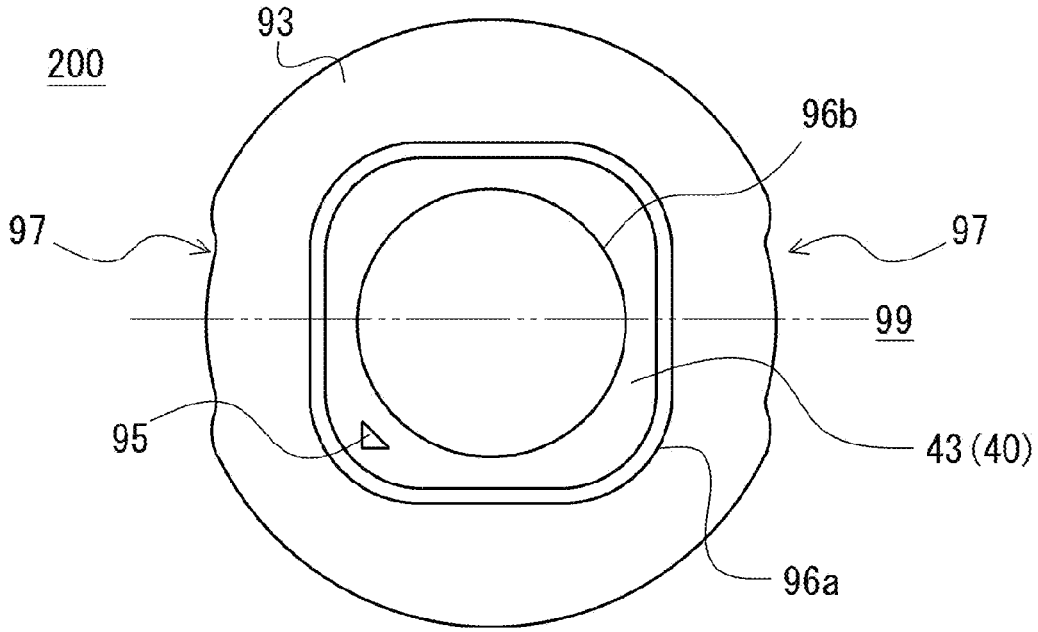
FIG. 24 is a schematic top view of a weak-snap type female snap in accordance with a seventh embodiment of the invention.
Figure 25:
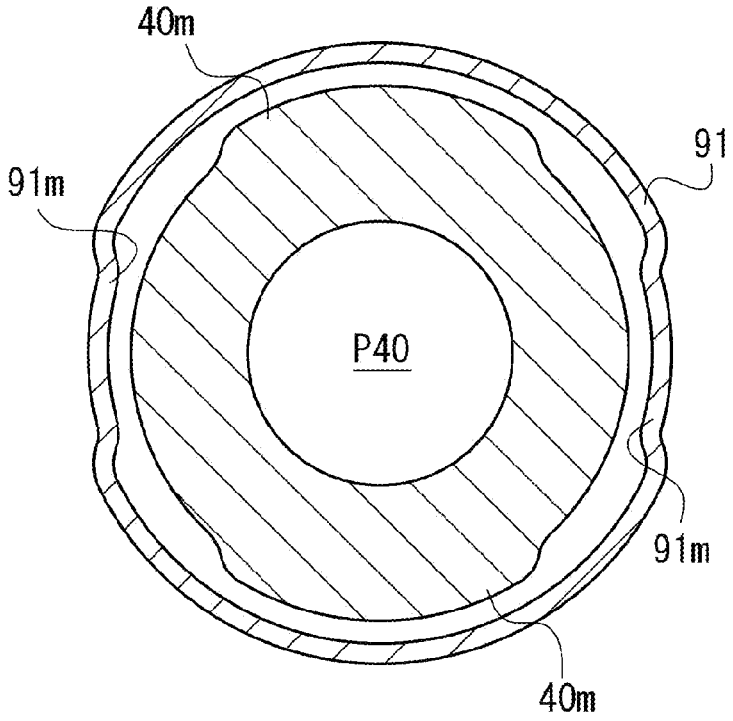
FIG. 25 is a schematic transverse cross-sectional view of a female snap taken along a dashed line X25-X25 in FIG. 22.
Figure 26:
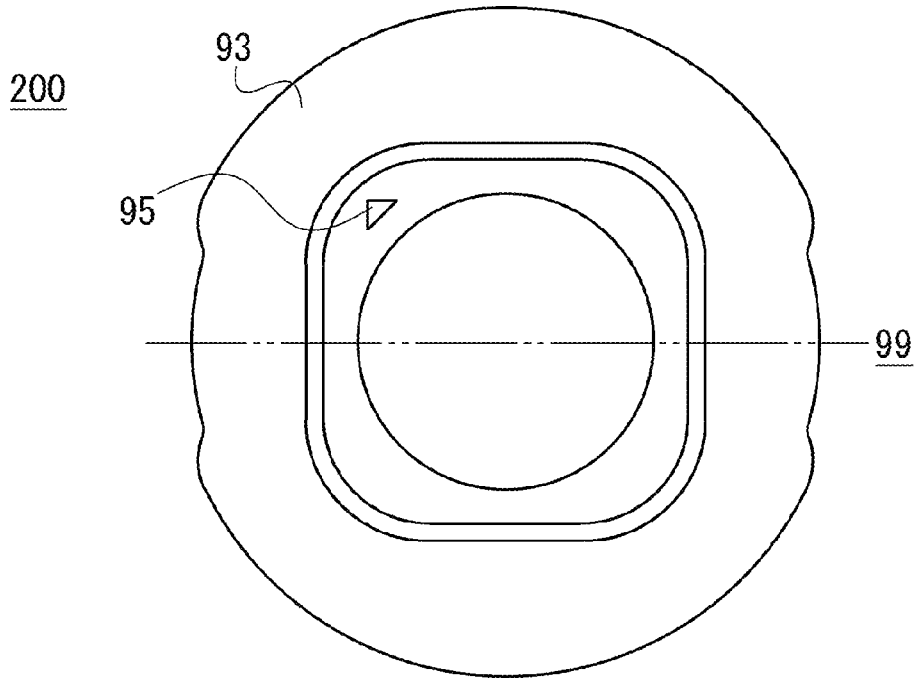
FIG. 26 is a schematic top view of a strong-snap type female snap in accordance with a seventh embodiment of the invention.
Figure 27:
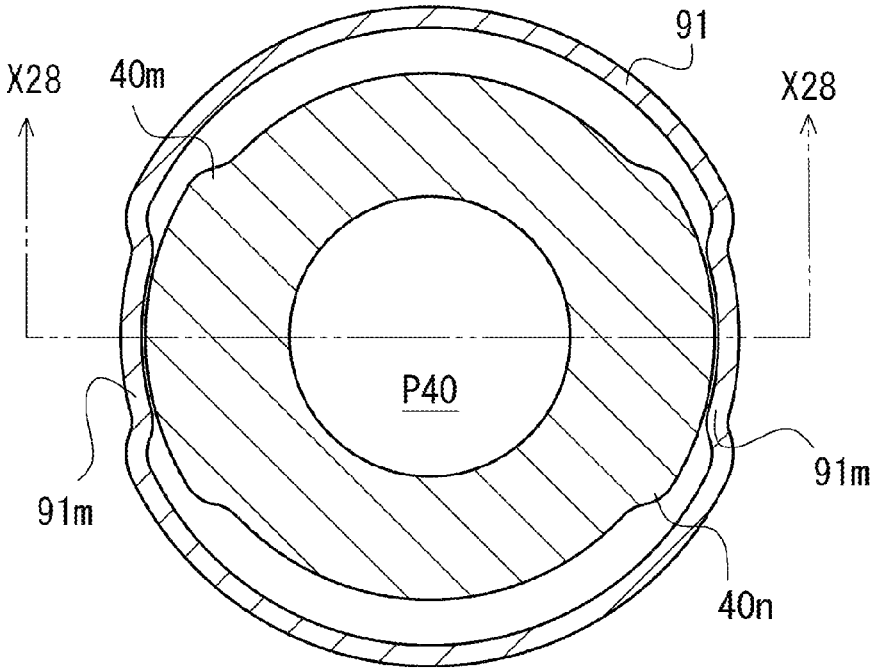
FIG. 27 is a schematic transverse cross-sectional view of a strong-snap type female snap in accordance with a seventh embodiment of the invention.
Figure 28:
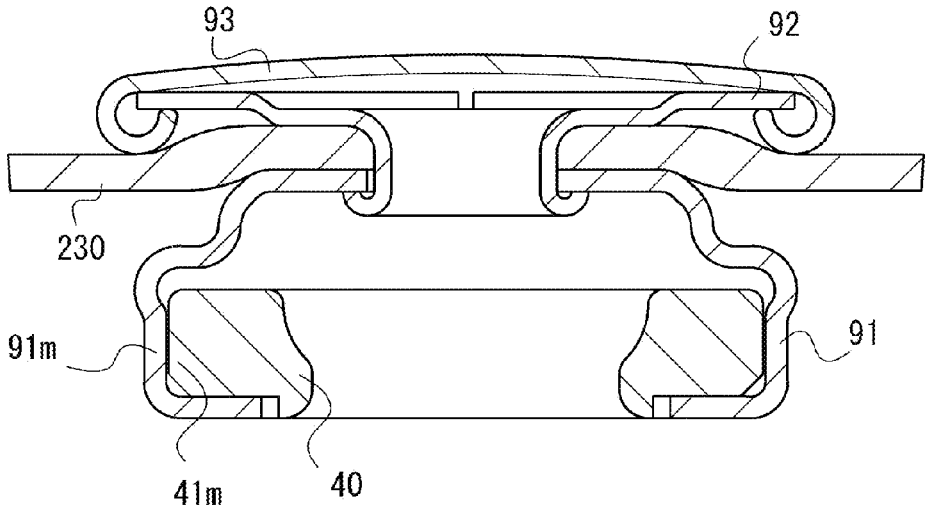
FIG. 28 is a schematic transverse cross-sectional view of a female snap taken along a dashed line X28-X28 in FIG. 27.

As noted above, in this embodiment, the relative position of the press portion and the pressed portion in the circumferential direction are preset/prefixed when manufacturing the female snap 210, wherein the strong snap type where the radial outward transformation of the ring body 40 is restricted and the weak snap type where the radial outward transformation of the ring body 40 is not restricted are manufactured individually. A description will be made on this fact further with reference to FIGS. 24-28. FIGS. 24 and 25 illustrate a type where the press portion and the pressed portion face each other. FIGS. 26-28 illustrate a type where the press portion and the pressed portion do not face each other. FIGS. 25 and 27 illustrate sectional configurations taken along a dashed line X25-X25 in FIG. 22.

In this example, the press portion 91*m* is configured by a radially inwardly depressed dent 97 having a predetermined length in the circumferential direction at the tube 91*b* of the holder 91. A feature in which the pressed portion 40*m* is provided at the ring body 40 is similar to the first embodiment.

In the weak snap type in which a mark 95 is provided at the underside of the ring body 40 as shown in FIG. 24, the pressed portion 40*m* and the press portion 91*m* do not face each other as shown in FIG. 25, and the radial outward transformation of the ring body 40 is not restricted. As shown in FIG. 24, the holder 91 has a quadrangular opening 96*a*. And, an annular projection 43 entering the opening 96*a* is provided at the underside of the ring body 40. In this embodiment, the annular projection 43 is much similar to a quadrangle than a circle. A triangular mark 95 is provided at the annular projection 43.

In the strong snap type shown in FIG. 26 in which the mark 95 is located at a different position than the position shown in FIG. 24, the pressed portion 40*m* and the press portion 91*m* face one another as shown in FIG. 27, and the radial outward transformation of the ring body 40 is restricted. FIG. 28 illustrates a cross-section of the female snap 210 taken along a dashed line X28-X28 in FIG. 27. As shown in FIG. 28, the pressed portion 40*m* of the ring body 40 and the press portion 91*m* of the tube 91*b* of the holder 91 are facing so that the radial outward transformation of the ring body 40 is restricted.

It may be easier to distinguish the weak snap type of FIG. 24 and the strong snap type of FIG. 26. As shown in FIG. 24, the outer side of the tube 91 of the female snap 210 is provided with two dents 97 provided at 180 degrees interval. Sandwiching the two dents 97 by a thumb and an index finder to hold the ring body 40 of the female snap 210 and then looking it in front, the mark 95 may be directed to left at near side or to right at far side for a viewer so that the weak snap type may be distinguishable which is shown in FIG. 24. Similarly, looking the ring body 40 of the female snap 210 in front, the mark 95 may be directed to left at far side or to right at near side for a viewer so that the strong snap type may be distinguishable which is shown in FIG. 26. Assuming a mirror surface 99 shown as a double-dashed line that couples each dent 97 at its center in the circumferential direction as shown in FIGS. 24 and 26, the mark 95 of the ring body 40 shown in FIG. 24 and the mark 95 of the ring body 40 shown in FIG. 26 may be in mirror-symmetry.

8th Embodiment

Eighth embodiment will be described with reference to FIGS. 29-32. In the above-described embodiments, the ring body may be made from a single annular elastic member. In contrast, in this embodiment, the ring body may be divided into plural components, and the transformation of the ring body may be achieved by the change in space between components arranged to form the ring body. Even in such a case, the ring body may recover to its initial shape owing to an elastic member such as a spring, and similar effects with the above-described embodiments may be achievable. When a metal material is utilized for the component of the ring body, its strength may be increased and the endurance of the snap button may be enhanced. In this embodiment, the ring body is evenly divided into two parts and leaf springs of elastic members are utilized for coupling the two parts. However, the number of the division of the ring body may not be prefixed and it may be divided to 3 or more parts. Any approach may be employed for elastically coupling the divided components and may not be necessarily limited to the use of a leaf spring described below.

It should be noted that, similar to the above-described embodiments, in accordance with the relative position of the press portion 10*m* and the pressed portion 40*m* in the circumferential direction, i.e. in accordance with the rotation of the ring body 40 with respect to the can body 10 in the circumferential direction, the degree of the transformation of the ring body 40 allowed by the can body 10 varies and the extent of the expansion of the aperture P40 of the ring body 40 allowed by the can body 10 varies.

Figure 29:
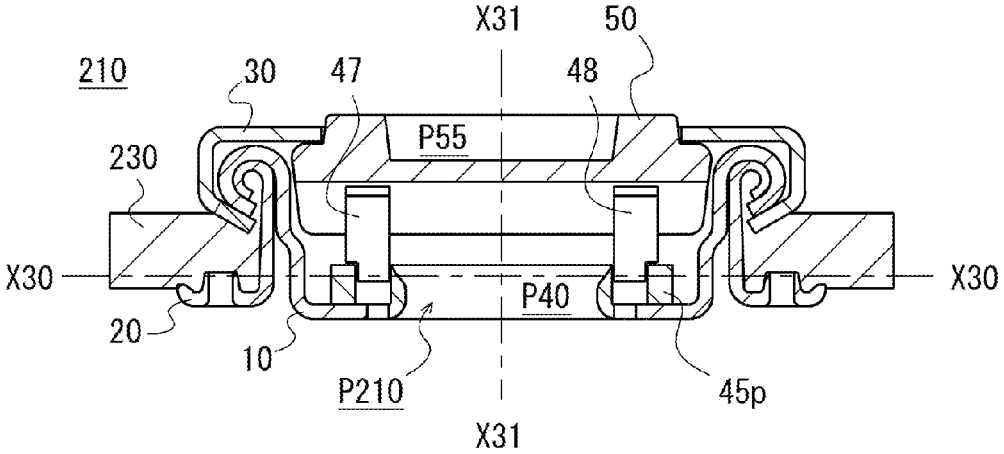
FIG. 29 is a schematic cross-sectional view of a female snap in accordance with an eighth embodiment of the invention.
Figure 30:
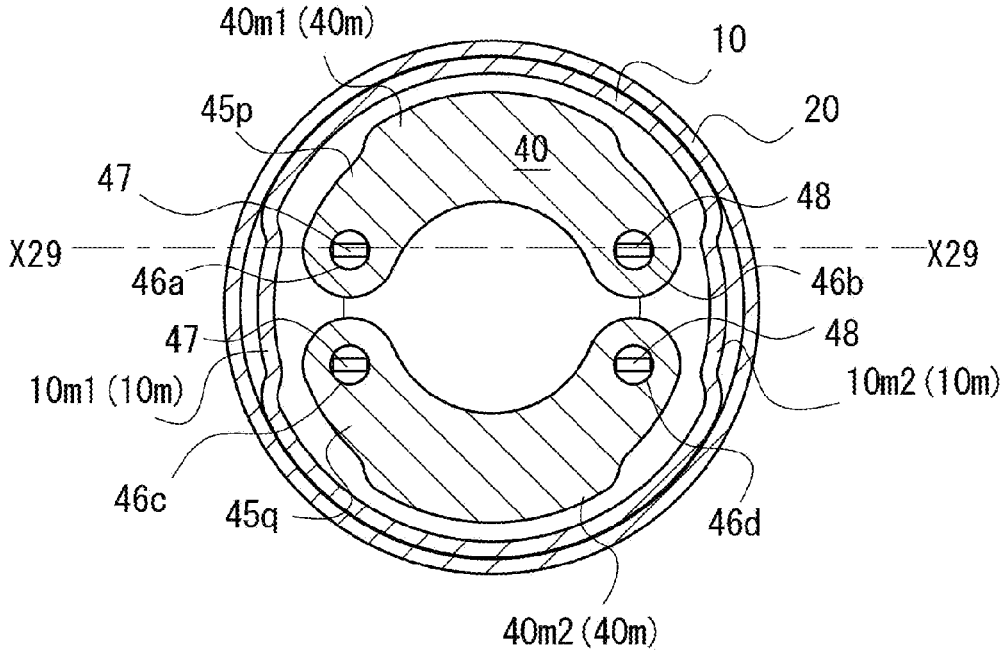
FIG. 30 is a schematic transverse cross-sectional view of a female snap taken along a dashed line X30-X30 in FIG. 29.
Figure 31:
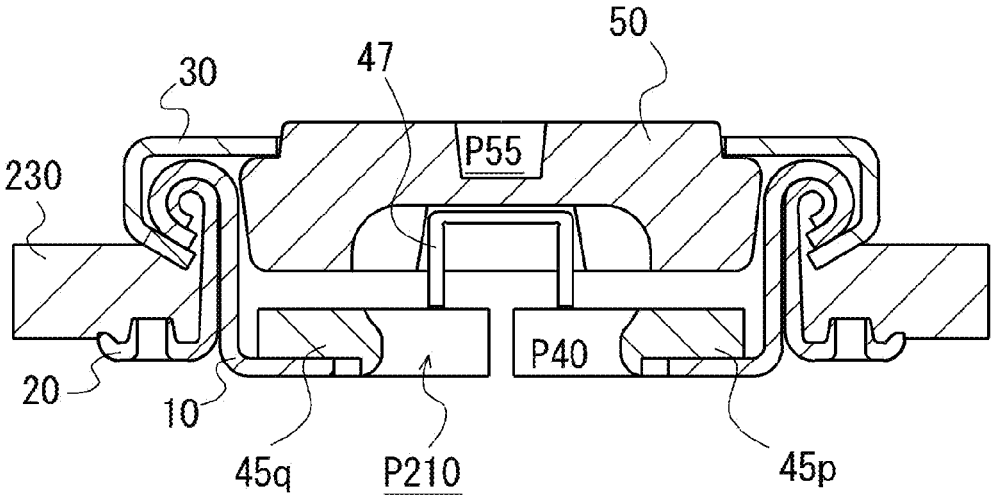
FIG. 31 is a schematic cross-sectional view of a female snap taken along a dashed line X31-X31 in FIG. 29.
Figure 32:
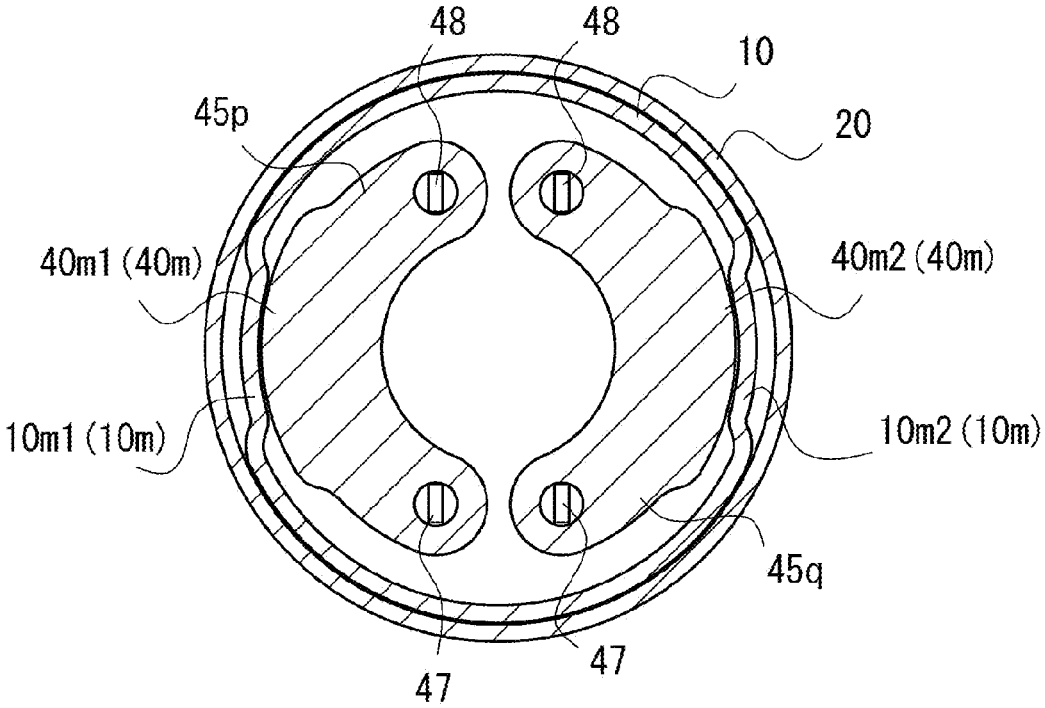
FIG. 32 is a schematic transverse cross-sectional view of a female snap rotated by 90 degrees from a position shown in FIG. 30.

FIG. 29 is a cross-section taken along a dashed line X29-X29 in FIG. 30. FIG. 30 is a schematic transverse cross-section of a female snap taken along a dashed line X30-X30 in FIG. 29. FIG. 31 is a schematic cross-section of a female snap taken along a line X31-X31 in FIG. 29. FIG. 32 is a schematic transverse cross-section of a female snap which has been rotated by 90 degrees from a position shown in FIG. 30. FIG. 30 corresponds to the state of FIG. 7 in the first embodiment. FIG. 32 corresponds to the state of FIG. 8 in the first embodiment.

As shown in FIGS. 29-32, the ring body 40 includes a U-shape part 45*p* and a U-shape part 45*q* which are formed by dividing a ring member. The ring body 40 is configured by coupling these U-shape parts 45*p*, 45*q* by leaf springs 47, 48. The U-shape parts 45*p*, 45*q* are U-shaped components view from above as shown in FIG. 30 and are arranged in opposed such that each U-shaped cave faces each other. The respective two ends of the U-shape part 45*p* are provided with through-holes 46*a*, 46*b* which penetrate therein in the insertion direction of the post, respectively. The respective two ends of the U-shape part 45*q* are provided with through-holes 46*c*, 46*d* which penetrate there in the insertion direction of the post, respectively. These through-holes are provided for inserting and fixing of the leaf spring that is for elastically coupling the U-shape parts provided apart. The leaf springs 47, 48 are shaped in the letter of U as seen in FIG. 31 and are provided with two insertion ends. Typically, the leaf spring is made of a metal, but not limited to, and a resin may be employed.

Those separate two U-shaped parts 45*p*, 45*q* are arranged to oppose one another so that the aperture P40 of the ring body 40 is defined. The post of the male snap is inserted into that aperture P40, and then the ring body 40 and the post are engaged. In respect of inserting and engaging the post of the male snap, the ring body (a first member) may preferably be an annular member, but this is just a non-limiting example.

For example, the first member may be configured from separate parts which are NOT unified by the leaf springs and so on and which are opposed and centered around the axis AX of a symmetry axis. In this case, in the direction of arrangement of respective parts, the dimension (interspace) between parts is normally less than the dimension of the head in the same direction. When engaging (when the post is allowed to be inserted), it becomes greater than the dimension of the head. After the head has passed therethrough, the space between the parts gets back to its normal value, thereby allowing the passing and engaging of the head. The manner of arranging the plural parts centered around the axis AX may include, for example, two part arranged to face each other, three parts arranged at an interval of 120 degrees in the circumferential direction, and five parts arranged at an interval of 72 degrees in the circumferential direction and so on. That is, at least one or more parts may be arranged around the post of the male snap, and the second member may be co-axially arranged at the outer side of that part in the direction apart from the axis AX. Various approaches may be employed for moving each part back to its initial position and, just as an example, an elastic member such as a leaf spring and so on may be employed.

As shown in FIG. 30, the two insertion ends of the leaf spring 47 are inserted to the through-holes 46*a*, 46*c*, respectively. The two insertion ends of the leaf spring 48 are inserted into the through-holes 46*b*, 46*d*, respectively. Accordingly, the U-shaped part 45*p* and the U-shaped part 45*q* are elastically coupled in a plane perpendicular to a depth direction of the receiving portion P210. When the post 105 of the male snap 220 is inserted into the receiving portion P210 of the female snap 210, the U-shaped part 45*p* and the U-shaped part 45*q* can be radially outwardly displaced, thereby the expansion of the width therebetween being secured. When the pressing by the post 105 of the male snap 220 is stopped, the U-shaped part 45*p* and the U-shaped part 45*q* displace radially inwardly, thereby the width therebetween recovers to its initial value.

In this embodiment, the U-shaped parts 45*p*, 45*q* are made of a metal and are elastically coupled each other. The metal U-shaped part may resist the repeating pressures by the post 105 of the male snap 220, thereby improving the endurance of the female snap 210. Further, in the state shown in FIG. 32, as an amount of transformation at the U-shaped part may be more restricted compared to a case where it is made of a resin, it may be more difficult in separating the female snap 210 and the male snap 220 which are coupled in up and down direction. Even assuming that a radial outward force is applied to the U-shaped parts from the post 105 of the male snap 220, widening the space between the U-shaped parts 45*p*, 45*q* is restricted. In this embodiment, the ring body 40 may be rotated from the state of FIG. 30 to the state of FIG. 32 so that the coupling of the female snap 210 and the male snap 220 may be firmly locked.

9th Embodiment

Figure 33:
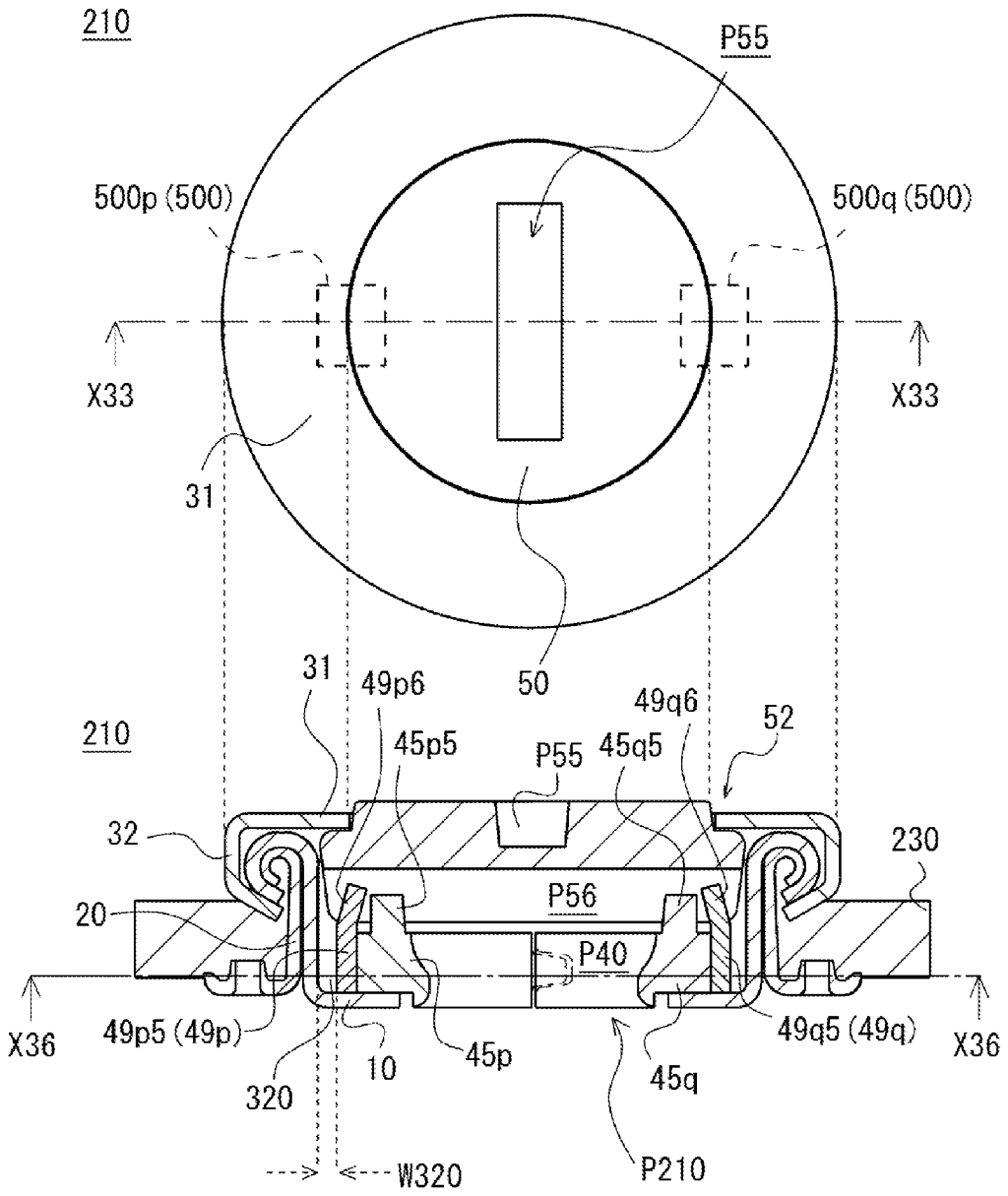
FIG. 33 illustrates schematic top and cross-sectional views of a female snap in accordance with a ninth embodiment of the invention, illustrating the top view at the upper section in the paper of FIG. 33, and the cross-sectional view at the bottom section in the paper of FIG. 33 which is taken along X33-X33 shown in the top view in the same figure.
Figure 34:
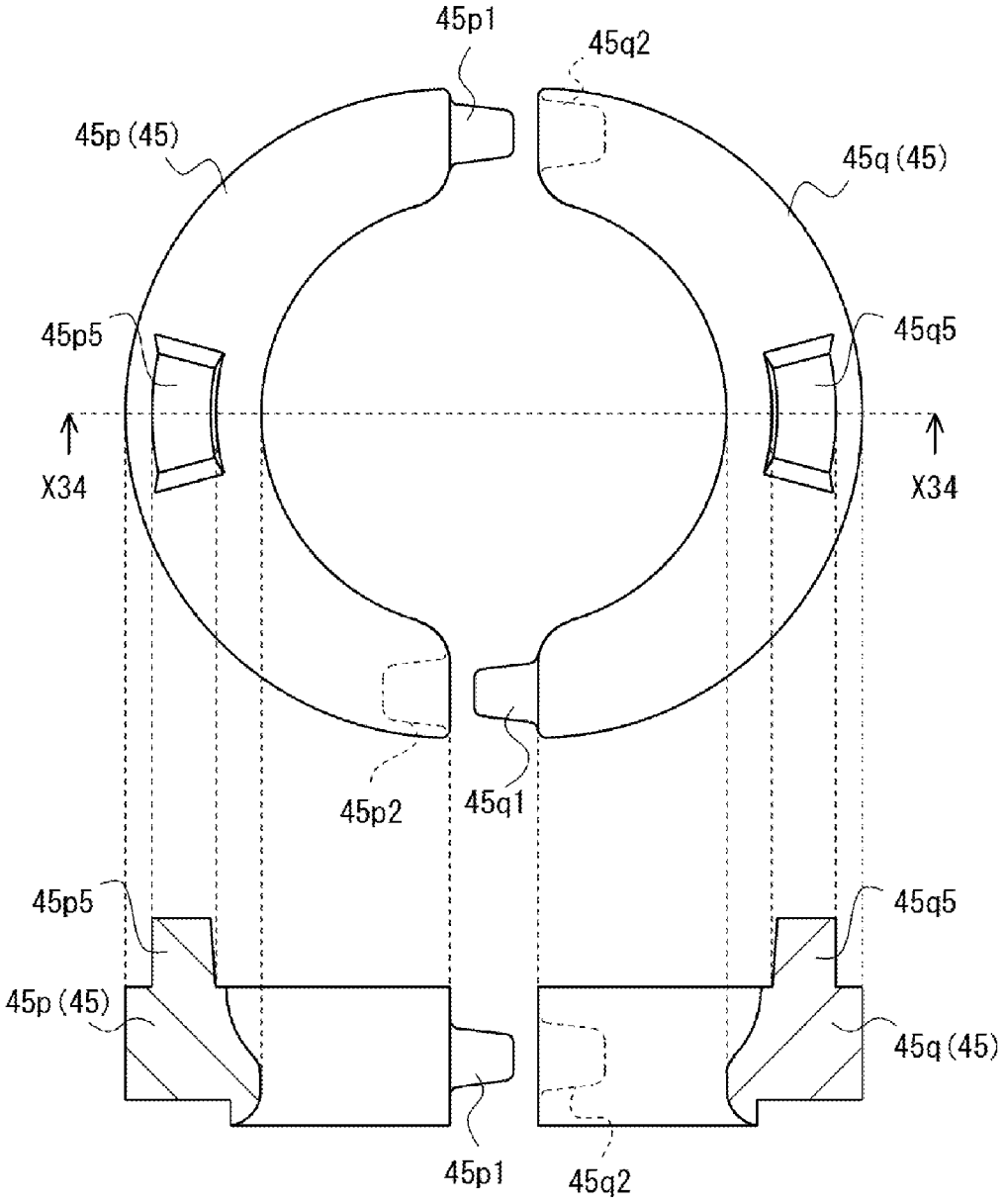
FIG. 34 illustrates schematic top and cross-sectional views of a ring body of a female snap in accordance with a ninth embodiment of the invention, illustrating the top view at the upper section in the paper of FIG. 34, and the cross-sectional view at the bottom section in the paper of FIG. 34 which is taken along X34-X34 shown in the top view in the same figure.
Figure 35:
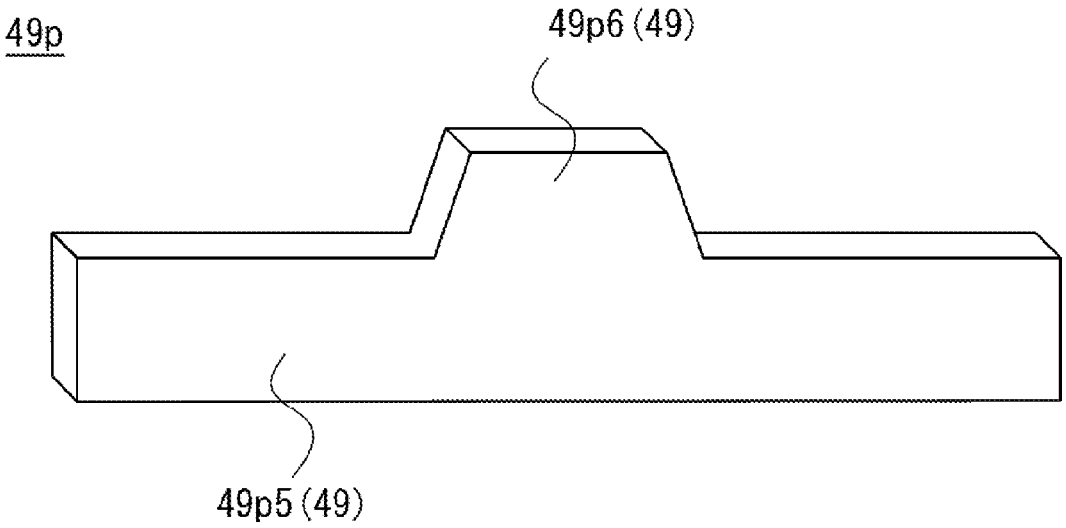
FIG. 35 is a schematic perspective view of a leaf spring of a female snap in accordance with a ninth embodiment of the invention.
Figure 36:
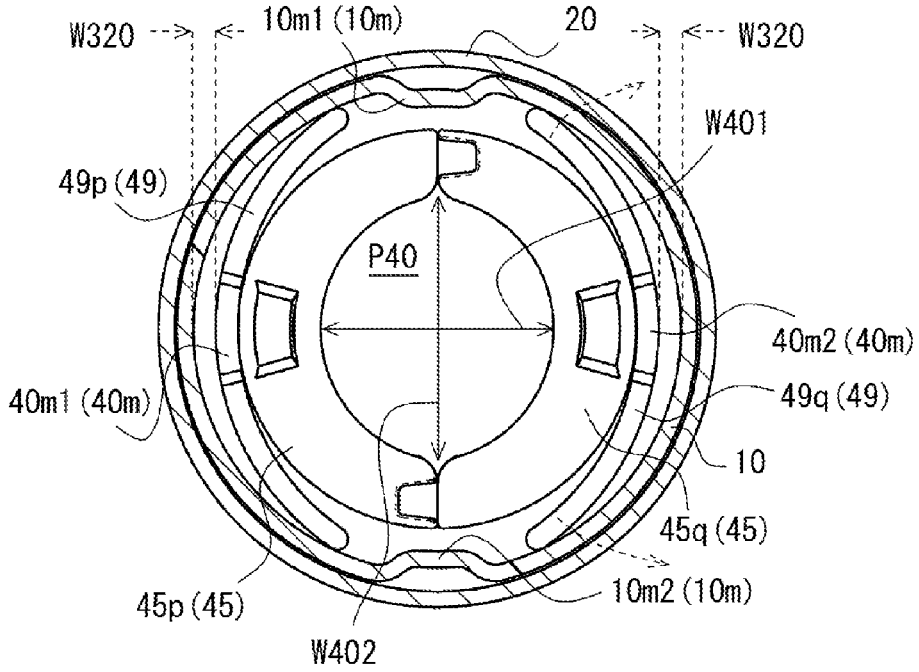
FIG. 36 is a schematic transverse cross-sectional view of a female snap in an unlocked state taken along a dashed line X36-X36 in the section of FIG. 33, schematically illustrating a combined state of U-shaped parts at (a) and a separate state of U-shaped parts at (b).
Figure 36:
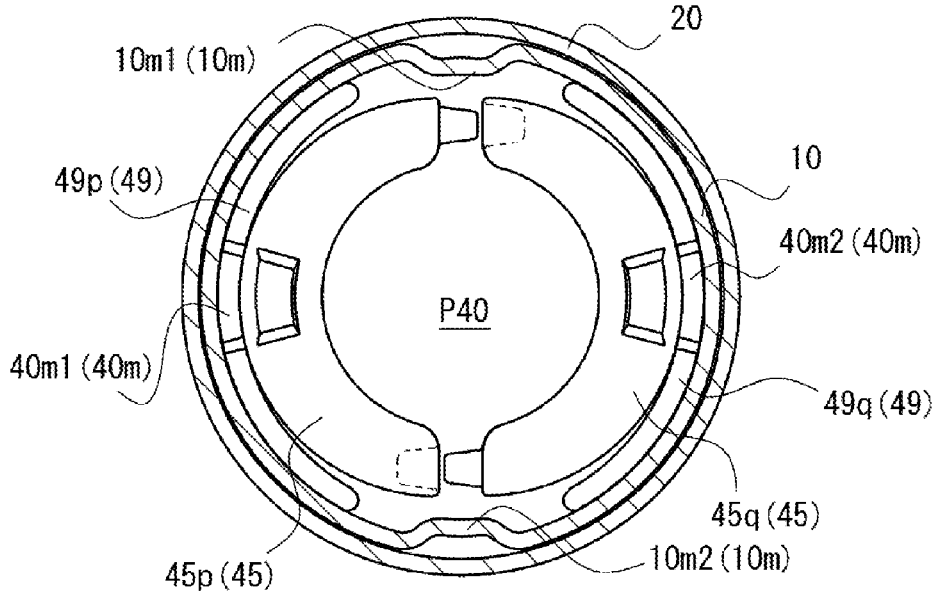
Figure 37:
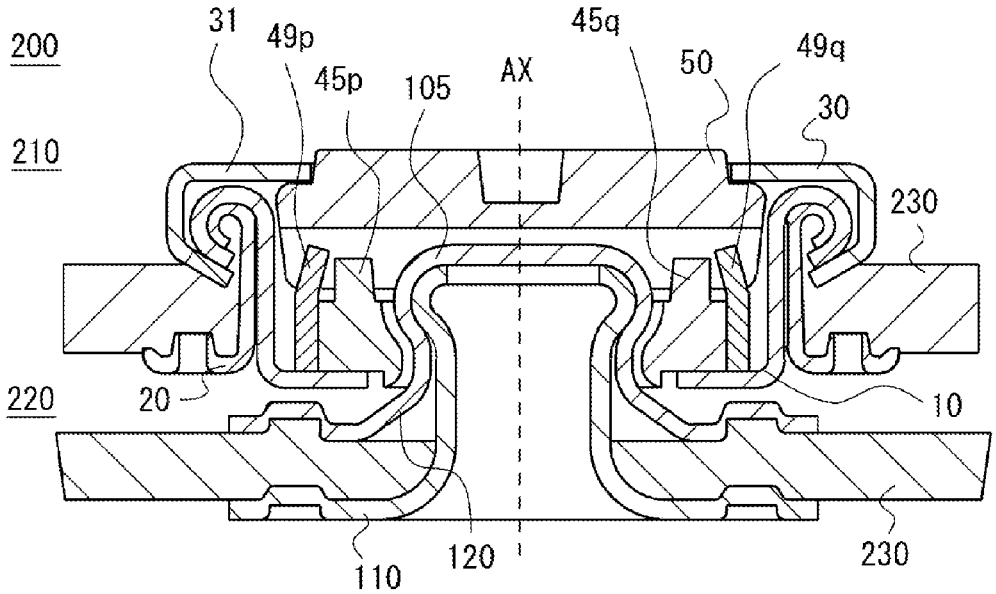
FIG. 37 is a schematic cross-sectional view of a snap button in accordance with a ninth embodiment of the invention in which a female snap is in unlocked state.
Figure 38:
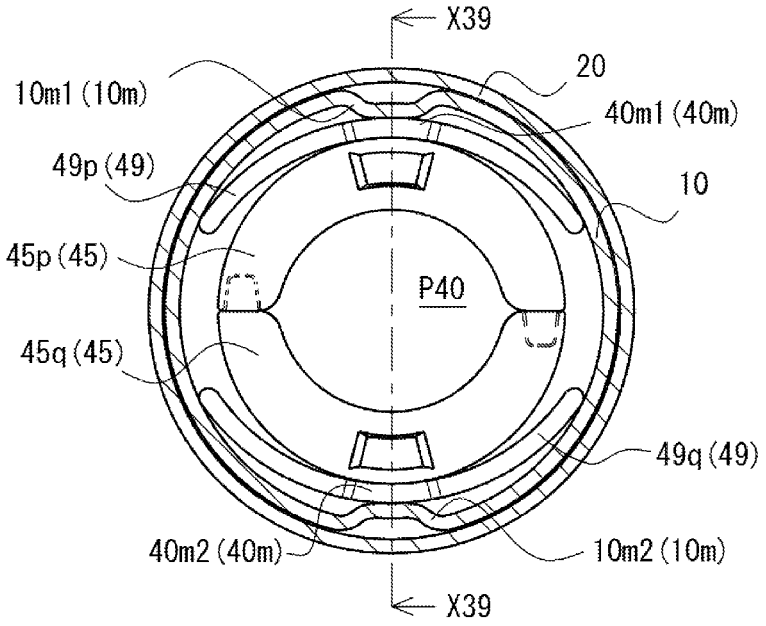
FIG. 38 is a schematic transverse cross-sectional view of a female snap in a locked state taken along a dashed line X36-X36 in the section of FIG. 33.
Figure 39:
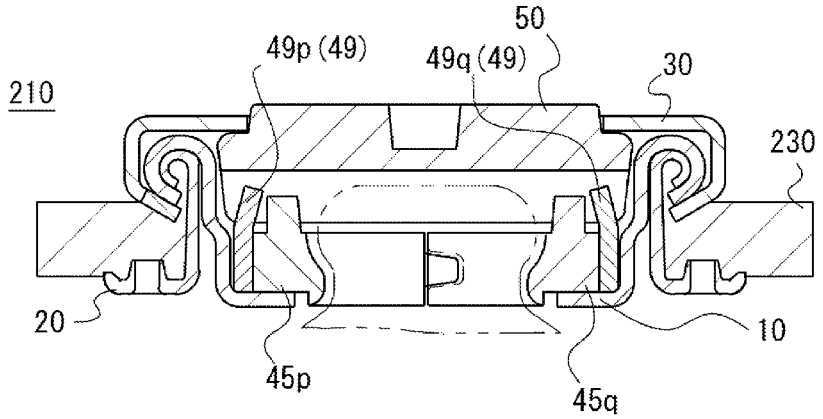
FIG. 39 is a schematic longitudinal cross-sectional view of a female snap in a locked state taken along a dashed line X39-X39 in FIG. 38.

Ninth embodiment will be described with reference to FIGS. 33-39. FIG. 33 illustrates schematic top and cross-sectional views of a female snap, where a top section of FIG. 33 illustrates the top view and a bottom section of FIG. 33 illustrates the cross-sectional view taken along X33-X33 in the top view shown in this figure. FIG. 34 illustrates schematic top and cross-sectional views of a ring body of a female snap, where the top section of FIG. 34 illustrates the top view and the bottom section of FIG. 34 illustrates the cross-sectional view taken along X34-X34 in the top view shown in this figure. FIG. 35 is a schematic perspective view of a leaf spring of a female snap. FIG. 36 illustrates a schematic transverse cross-sectional view of an unlocked female snap taken along a dashed line X36-X36 in the cross-sectional view of FIG. 33, where (a) schematically illustrates a combined state of U-shaped parts and (b) schematically illustrates a separated state of U-shaped parts. FIG. 37 is a schematic cross-sectional view of a snap button in which the female snap is under an unlocked state. FIG. 38 is a schematic transverse cross-sectional view of a locked female snap taken along a dashed line X36-X36 in the cross-sectional view of FIG. 33. FIG. 39 is a schematic cross-sectional view of a locked female snap taken along a dashed line X39-X39 in FIG. 38.

In this embodiment, unlike the 8th embodiment, leaf springs 49 extending in the circumferential direction between the ring body 40 and the can body 10 supplies the urging to the U-shaped part 45 created by evenly dividing the ring body 40 to two parts. Even in such a case, similar effects with the above-described embodiments may be achievable. The length of the leaf spring 49 may be regulated so that an appropriate spring force may be easily obtainable and further a substantial spring force may be readily obtainable. The increase in the spring force may increase the engagement force of the female snap 210. The increase in the spring force is expected to enhance the endurance of the female snap 210 for repeated uses.

In this example, as shown in FIG. 36, each leaf spring 49 is positioned between two projections 10*m*1, 10*m*2 which are provided at an interval of 180 degrees in the circumferential direction. Each leaf springs 49 may be displaced in the circumferential direction in synchronization with the rotation of the rotator 50, and may be positioned radially inwardly relative to the two projections 10*m*1, 10*m*2 as shown in FIG. 38.

In this embodiment, the U-shaped parts 45*p*, 45*q* are not coupled by a leaf spring, and the U-shaped parts 45*p*, 45*q* are just loosely coupled by a loose fit there-between. Coupling the U-shaped parts 45*p*, 45*q* is not required compared to the 8th embodiment, and thus simplification of the assembling of the female snap 210 may be facilitated.

It should be noted that, similar to the above-described embodiments, in accordance with the relative position of the press portion and the pressed portion in the circumferential direction, i.e. in accordance with the rotation of the ring body 40 with respect to the can body 10 in the circumferential direction, the degree of the transformation of the ring body 40 allowed by the can body 10 varies and the extent of the expansion of the aperture P40 of the ring body 40 allowed by the can body 10 varies.

The ring body 40 placed in the can body 10 is comprised of a pair of U-shaped parts 45*p*, 45*q* as shown in FIGS. 33 and 34. One end face of the U-shaped part 45*p* is provided with a projecting fit portion 45*p*1, and the other end face of the U-shaped part 45*p* is provided with a recessed fitted portion 45*p*2. An insertion boss 45*p*5 is provided on a top side at a middle between the both ends of the U-shaped part 45*p*. The insertion boss 45*p*5 is inserted into a recessed inserted portion 500*p* provided at the underside of the rotator 50 mounted on the ring body 40. The configuration of the U-shaped part 45*q* is similar to the U-shaped part 45*p*, thus duplicative explanations shall be omitted. A projecting fit part 45*q*1, a recessed fitted part 45*q*2, and an insertion boss 45*q*5 of the U-shaped part 45*q* correspond to the projecting fit part 45*p*1, the recessed fitted part 45*p*2, and the insertion boss 45*p*5 of the U-shaped part 45*p*.

The projecting fit part 45*p*1 of the U-shaped part 45*p* loosely fits the recessed fitted part 45*q*2 of the U-shaped part 45*q*, and the projecting fit part 45*q*1 of the U-shaped part 45*q* loosely fits the recessed fitted part 45*p*2 of the U-shaped part 45*p*. Therefore, the increase and decrease of the interspace between the U-shaped part 45*p* and the U-shaped part 45*q*, i.e. the increase and decrease in the aperture width of the aperture P40 of the ring body 40 may be secured.

A pair of leaf springs 45*p*, 45*q* are provided in the can body 10 corresponding to the above-described pair of U-shaped parts 45*p*, 45*q* as shown in FIG. 33 and FIG. 35. As shown in FIG. 35, the leaf spring 49*p* is a flat metal plate having a constant thickness at its initial pose. The leaf spring 49*p* has an elongated flat plate 49*p*5, and a projecting insertion leg 49*p*6 provided at the middle between the both ends of the flat plate 49*p*5. The configuration of the leaf spring 49*q* is similar to the leaf spring 49*p*, therefore duplicative explanations shall be omitted.

A description will be made with reference to FIG. 36 together. The leaf spring 49*p* is position between the U-shaped part 45*p* and the can body 10, and the flat plate

49$p$5 is forced to curve in an arc between the outer side of the U-shaped part 45$p$ and the inner side of the can body 10, resulting in that a spring force is given to the flat plate 45$p$5 of the leaf spring 49$p$ for getting back to its linear initial pose. Similarly, the leaf spring 49$q$ is positioned between the U-shaped part 45$q$ and the can body 10, and a spring force is applied thereto which is equal to the spring force of the leaf spring 49$p$. When a leaf plate is utilized as urging means for urging the U-shaped part 45 radially inwardly, the continuous space in the circumferential direction between the ring body 40 and the can body 10 may be utilized so that enough length of the leaf spring is readily secured, i.e. this being suitable for having a substantial spring force.

As shown in FIG. 36($a$), a spring force is given to the flat plate 49$q$5 of the leaf spring 49$q$ such that both ends thereof are subjected to be displaced radially outwardly. The inner side of the can body 10 is pressed by the both ends of the flat plate 49$q$5 of the leaf spring 49$q$ so that the U-shaped part 45$q$ is radially inwardly urged accordingly. Similarly, the U-shaped part 45$p$ is urged radially inwardly in accordance with a spring force of the leaf spring 49$p$. As a result, the U-shaped part 45$p$ and the U-shaped part 45$q$ are closed, thereby securing and maintaining an initial state where the space between the arranged parts is minimum.

The insertion leg 49$p$6 of the leaf spring 49$p$ is inserted to the recessed inserted portion 500$p$ provided at the underside of the rotator 50 together with the insertion boss 45$p$5 of the U-shaped part 45$p$. The insertion leg 49$q$6 of the leaf spring 49$q$ is inserted to the recessed inserted portion 500$q$ provided at the underside of the rotator 50 together with the insertion boss 45$q$5 of the U-shaped part 45$q$. The rotator 50 rotates, and the pair of U-shaped parts and the pair of leaf springs are forced to rotate around the axis AX accordingly. Each U-shaped part and each leaf spring may be attached to the rotator 50 separately, and thus easier assembling is achieved.

In FIG. 36($a$), a clearance with sufficient width W320 is provided between the leaf spring 49$p$, 49$q$ and the can body 10, allowing the expansion of the interspace between the arranged U-shaped part 45$p$ and the U-shaped part 45$q$. The above-described clearance is provided as a result of that the both ends of the leaf spring 49$p$, 49$q$ contact the inner side of the can body 10 and a spring force is given to the flat plate 45$p$5 of the leaf spring 49$p$, 49$q$ to move back to the linear initial orientation.

FIG. 36($b$) schematically illustrates how the post 105 of the male snap 220 is inserted to or drawn out of the receiving portion P210 of the female snap 220. It is provided that a pressing force is applied to each U-shaped part 45 by the post 105 which surpasses an urging force given to each U-shaped part 45 by each leaf spring 49. In the course of inserting and drawing out, the U-shaped part 45$p$ is pressed radially outwardly by the post 105 and the U-shaped part 45$q$ is pressed radially outwardly by the post 105, thus expanding the interspace between the U-shaped part 45$p$ and the U-shaped part 45$q$ and expanding the aperture width of the aperture P40. It can be said that the extent of the expansion of the aperture P40 allowed by the can body 10 is large.

In FIG. 36($b$), the above-described clearance between the leaf spring 49$p$, 49$q$ and the can body 10 is removed; the aperture width of the aperture P40 of the ring body 40 is at the maximum; and further expansion of the aperture width is restricted by the stiffness of the can body 10. FIG. 36($b$) merely schematically illustrates an instantaneous state, so the projecting fit part 45$p$1 of the U-shaped part 45$p$ is NOT necessarily fully drawn out of the recessed fitted part 45$q$2 of the U-shaped part 45$q$ as shown in the same figure.

The aperture P40 is provided with a first aperture width W401 measured in the arrangement direction of the pair of U-shaped parts 45$p$, 45$q$, and a second aperture width W402 measured in a direction perpendicular to that arrangement direction. The first aperture width W401 is narrower than the maximum diameter of the head 105$b$ of the post 105 when the U-shaped parts 45$p$, 45$q$ are coupled to form a ring, and it is wider than the maximum diameter of the head 105$b$ of the post 105 when the U-shaped parts 45$p$, 45$q$ are provided apart. On the other hand, the second aperture width W402 is arranged slightly wider than the maximum diameter of the head 105$b$ of the post 105. The first aperture width W401 increases so that the pass of the post 105 through the aperture P40 is allowed accordingly. The first aperture width W401 decreases so that the engagement between the post 105 and the female snap 210 is secured accordingly. When the U-shaped parts 45$p$, 45$q$ are coupled to form a ring, the aperture shape of the aperture P40 presents an oval having a wider width in the arrangement direction of the U-shaped parts 45$p$, 45$q$.

After that the male snap 220 has snapped in the female snap 210 as shown in FIG. 37, each U-shaped part 45$p$, 45$q$ is urged radially inwardly by each leaf spring 49$p$, 49$q$ so that the post 105 will be sandwiched by the annularly coupled U-shaped parts 45$p$, 45$q$. Accordingly, the post 105 is engaged with the female snap 210. The above-described first aperture width W401 recovers, based on the elasticity of the leaf spring 49, from a wider aperture width to a narrower aperture width relative to the maximum diameter of the head 105$b$ of the post 105. In accordance with the radial inward displacement of the U-shaped part 45 by the leaf spring 49, the aperture width of the aperture P40 of the ring body 40 decreases from a widened aperture width of FIG. 36($b$) to an initial aperture width of FIG. 36($a$).

If the male snap 220 is to be drawn out of the female snap 210 at the state shown in FIG. 37, a radial outward pressing force given to each U-shaped part 45 by the post 105 surpasses the spring force given by each leaf spring 49, thus the width between the U-shaped parts 45$p$, 45$q$ widens, i.e. the aperture P40 of the ring body 40 widens, thereby allowing the momentum pass of the post 105 through the aperture P40 of the ring body 40.

Similar to the above-described embodiment, the engagement force of the female snap 210 may be regulated based on the rotation of the rotator 50. When the rotator 50 shown in FIG. 33 is rotated clockwise by 90 degrees when viewing the FIG. 33 in front, the female snap 210 is shifted from an unlocked state shown in FIG. 36 to a locked state shown in FIG. 38.

At a time shown in FIG. 38, the leaf spring 49$p$, the U-shaped part 45$p$, the U-shaped part 45$q$, and the leaf spring 49$q$ between the pair of press portions 10$m$ of the can body 10 are sandwiched by the pair of press portions 10$m$, where the radial outward displacement of each U-shaped part 45$p$, 45$q$, the expansion of the interspace between the arranged U-shaped parts 45$p$, 45$q$, and the expansion of the aperture of the ring body 40 are totally or practically not possible. Specifically, the press portion 10$m$ of the can body 10 touches the leaf spring 49$p$, 49$q$, and the opposite side to that contacted side touches the U-shaped part 45$p$, 45$q$. The leaf spring 49$p$, 49$q$ touches the press part 10$m$ so that the extent of the expansion of the aperture P40 surrounded by the pair of U-shaped parts 45$p$, 45$q$ is suppressed.

The contact point between the leaf spring 49$p$, 49$q$ and the can body 10 for giving a spring force to the leaf spring 49 and the contact point between the leaf spring 49$p$, 49$q$ and the can body 10 for suppressing the extent of the expansion of the aperture P40 are located at different points. The contact points of the leaf spring 49 against the can body 10 for giving the spring force to the leaf spring 49 are located at both ends of the leaf spring 49$p$, 49$q$. As to the can body 10, they are located at the inner side of the can body 10 next to the press portion 10$m$ in the circumferential direction. The contact point of the leaf spring 49 against the can body 10 for suppressing the extent of the expansion of the aperture is located around the middle of the leaf spring 49$p$, 49$q$. As to the can body 10, it is located at the inner side of the press portion 10$m$. A point where an imaginary line parallel to a direction in which the pair of U-shaped parts 45$p$, 45$q$ mutually moves apart and passing at the center of the aperture P40 intersects the leaf spring 49$p$, 49$q$ is provided around the middle between both ends of the leaf spring 49$p$, 49$q$ so that the extent of the expansion of the aperture P40 may be preferably suppressed.

At a time shown in FIG. 38, the radial outward displacement of the U-shaped part 45$p$, 45$q$ allowed by the can body 10 is practically zero. Therefore, the post 105 of the male snap 220 may not engage with the receiving portion P21 of the female snap 210 even being pressed into. Under the configuration shown in FIG. 38, it may be possible to lower the height of the press portion 10$m$ by the amount of the thickness of the leaf spring 49.

In this example, the pressed portion 40$m$1 provided at the ring body 40 is the middle portion in the longitudinal direction of the flat plate 49$p$5 of the leaf spring 49$p$. The pressed portion 40$m$2 provided at the ring body 40 is the middle portion in the longitudinal direction of the flat plate 49$q$5 of the leaf spring 49$q$.

There may be totally or practically no clearance between the leaf spring 49$p$, 49$q$ and the can body 10 when the post 105 of the male snap 220 snaps in the female snap 210 as schematically shown in FIG. 39, therefore even though trying to draw the post 105 out of the receiving portion P210 of the female snap 210, the U-shaped part 45$p$, 45$q$ may not be able to radially outwardly displace totally or practically, thereby preventing the disengagement of the female snap 210 and the male snap 220. In this embodiment, the engagement force of the female snap button may have a significant range, and a significant difference in the engagement force may be given between the locked state and the unlocked state of the post of the male snap. The can body 10, the U-shaped parts 45$p$, 45$q$, and the leaf springs 49$p$, 49$q$ are made of a metal so that the strong engagement force may be achieved for the female snap 210.

The assembling of the female snap 210 may be achievable by fitting the U-shaped parts 45$p$, 45$q$ and the leaf springs 49$p$, 49$q$ against the rotator 50 by an insertion, next placing this inside of the can body 10, and then closing it by the cover 30, for example.

10th Embodiment

Figure 40:
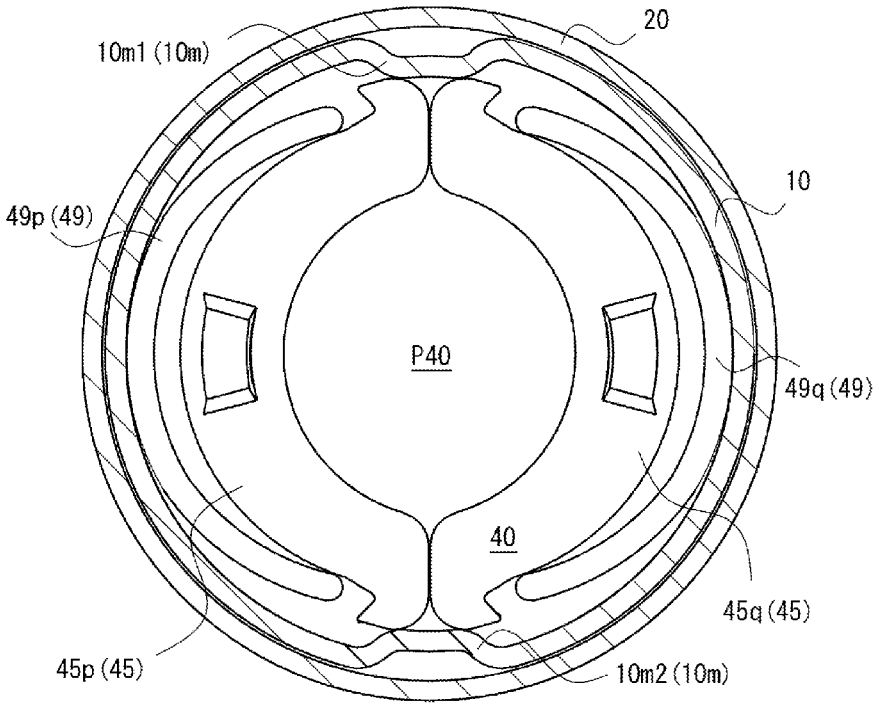
FIG. 40 is a schematic transverse cross-sectional view of a female snap in accordance with a tenth embodiment of the invention.
Figure 41:
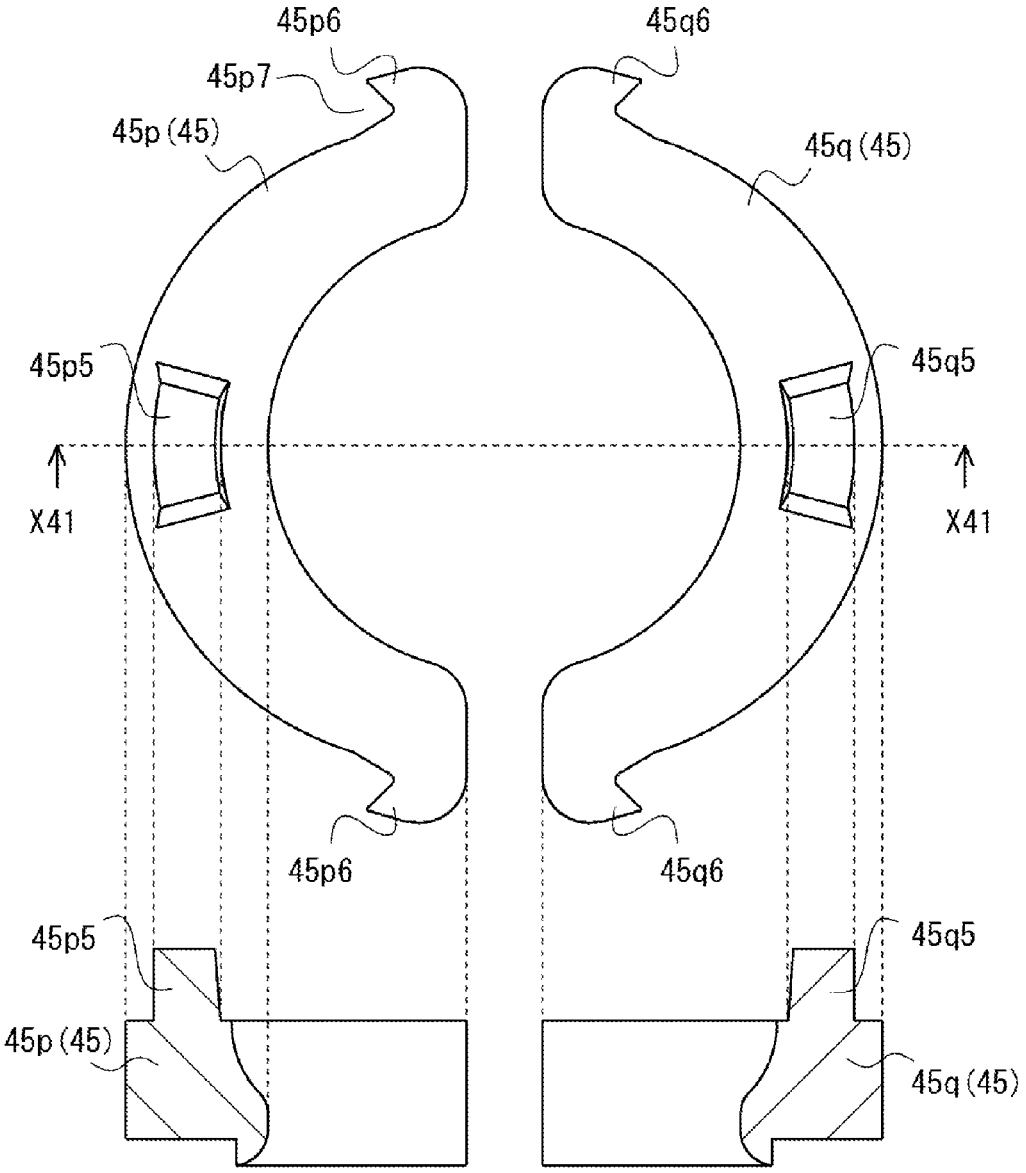
FIG. 41 illustrates schematic top and cross-sectional views of a ring body of a female snap in accordance with a tenth embodiment of the invention, illustrating the top view at the upper section in the paper of FIG. 41, and the cross-sectional view at the bottom section in the paper of FIG. 41 which is taken along X41-X41 in the top view shown in the same figure.
Figure 42:
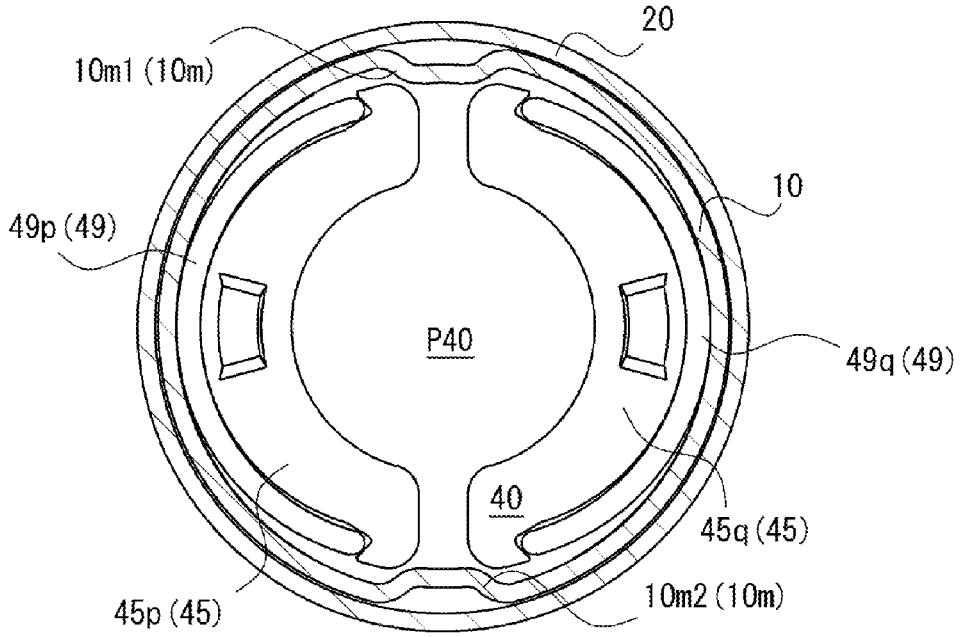
FIG. 42 is a schematic transverse view of a female snap in accordance with a tenth embodiment of the invention, illustrating an unlocked state at (a) and a locked state at (b).
Figure 42:
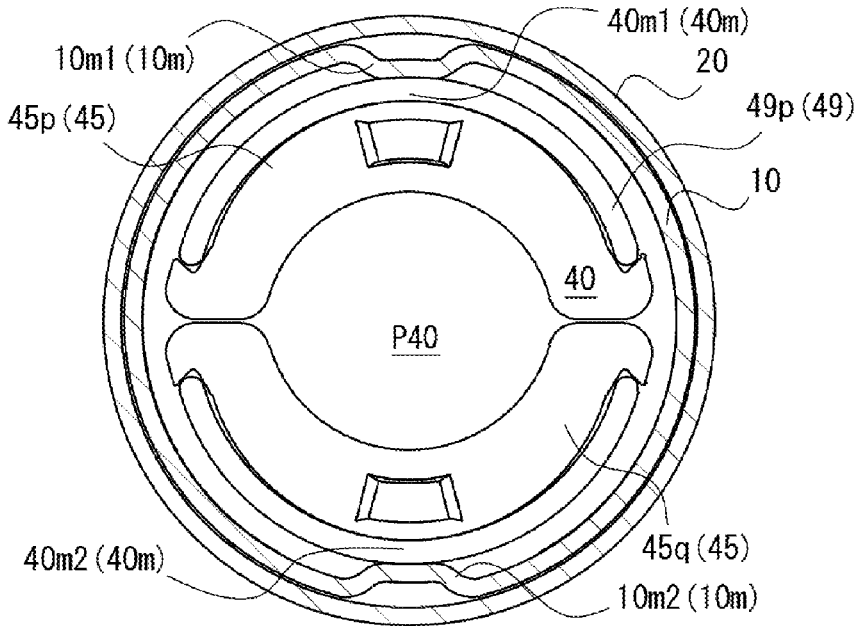

Tenth embodiment will be described with reference to FIGS. 40-42. FIG. 40 illustrates schematic transverse cross-sectional view of a female snap. FIG. 41 illustrates schematic top and cross-sectional views of a ring body of a female snap, where a top section of FIG. 41 illustrates the top view and a bottom section of FIG. 41 illustrates the cross-sectional view taken along X41-X41 in the top view shown in this figure. FIG. 42 illustrates a schematic transverse cross-sectional view of a female snap, where (a) illustrates an unlocked state and (b) illustrates a locked state. In this embodiment, unlike the 9th embodiment, a carrier is provided at the ring body 40 for entraining the leaf spring 49 instead of engaging the leaf spring 49 against the rotator 50. Even in such a configuration, similar effects with the above-described embodiments may be achievable.

As shown in FIGS. 40 to 42, the initial shape of the leaf spring 49$p$ is formed like the letter of C, and the leaf spring 49$p$ is placed between the U-shaped part 45$p$ and the can body 10 such that the both ends of the leaf spring 49$p$ are pushed to be apart. In such a case, a spring force for narrowing the width between the both ends of the leaf spring 49$p$ is given to the leaf spring 49$p$, and the U-shaped part 45$p$ is radially inwardly urged accordingly. The same explanation holds true for the leaf spring 49$q$ and the U-shaped part 45$q$.

As shown in FIG. 40 and FIG. 41, the both ends of the U-shaped part 45$p$ is not provided with projecting fit part and recessed fitted part which are shown in the 9th embodiment, and the both end faces of the U-shaped part 45$p$ are made to be flat. The U-shaped part 45$q$ is structured similarly. The U-shaped parts 45$p$, 45$q$ are retained to mutually sit side by side in the can body 10 as they are urged radially inwardly by the leaf spring 49$p$, 49$q$. Therefore, the mutual coupling of the U-shaped parts 45$p$, 45$q$ such as by fitting is not a prerequisite.

As shown in FIG. 41, the each end of the U-shaped part 45$p$, 45$q$ is provided with a ridge 45$p$6 radially outwardly bulging from the outer side of the end to form a recessed concavity 45$p$7 so that a torque is conveyed from the U-shaped part 45$p$, 45$q$ to the leaf spring 49$p$, 49$q$, allowing the displacement of the leaf spring 49$p$, 49$q$ in the circumferential direction in synchronization with the circumferential displacement of the U-shaped part 45$p$, 45$q$. The pair of ridges 45$p$6 provided at one end and the other end of the U-shaped part 45 may form a carrier for entraining the leaf spring 49 in accordance with the rotation of the ring body 40.

FIG. 42($a$) illustrates, in an unlocked state where the space between the arranged U-shaped part 45$p$ and the U-shaped part 45$q$ is possibly widened, a state where the space between the arranged U-shaped part 45$p$ and the U-shaped part 45$q$ is actually widened by the post 105 of the male snap 220 which is not shown. FIG. 42 ($b$) illustrates a locked state where the ring body 40 has been rotated clockwise by 90 degrees from a position shown in FIG. 42 ($a$) and thus the space between the arranged U-shaped part 45$p$ and the U-shaped part 45$q$ is not possibly widened.

As will be apparent from the comparison of FIG. 42($a$) and FIG. 42($b$), if the ring body 40 is rotated clockwise, the leaf plate 49$p$ is moved in synchronization with the displacement of the U-shaped part 45$p$. The similar explanation holds true for the U-shaped part 45$q$ and the leaf spring 49$q$. At a moment shown in FIG. 42($b$), the leaf spring 49$p$, the U-shaped part 45$p$, the U-shaped part 45$q$, and the leaf spring 49$q$ between the pair of press portions 10$m$ of the can body 10 are sandwiched by the pair of press portions 10$m$, where the expansion of the space between the arranged U-shaped part 45$p$ and the U-shaped part 45$q$ and the expansion of the aperture P40 of the ring body 40 are totally or practically not possible.

The assembling of the female snap 210 may be achievable by fitting the U-shaped parts 45$p$, 45$q$ against the rotator 50 by an insertion, next placing this inside of the can body 10, placing the leaf spring 49 in the can body 10 at any step and by any manner, and then closing it by the cover 30, for example.

11th Embodiment

Figure 43:
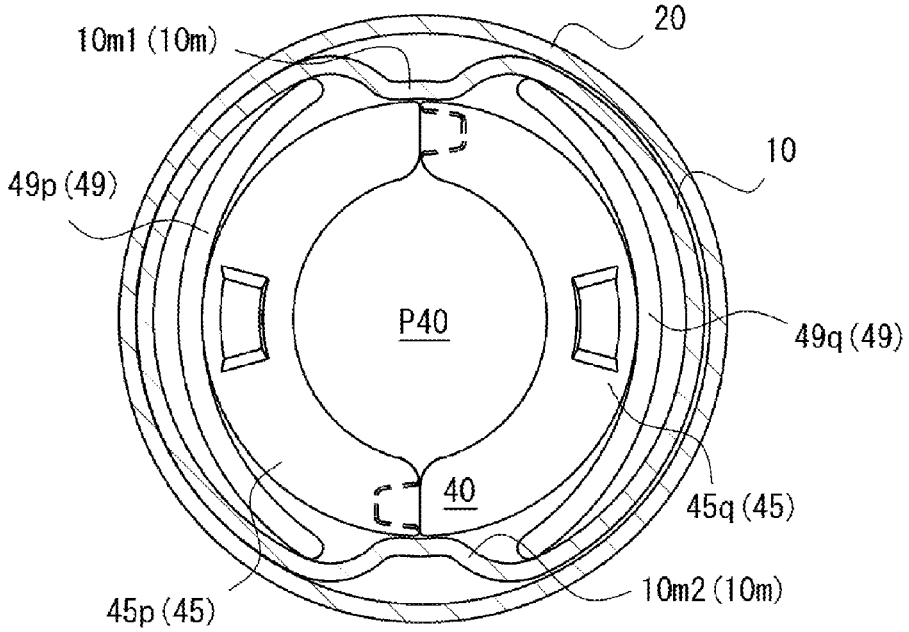
FIG. 43 is a schematic transverse cross-sectional view of a female snap in accordance with a eleventh embodiment of the invention, illustrating a combined state of U-shaped parts at (a) and a separate state of U-shaped parts at (b).
Figure 43:
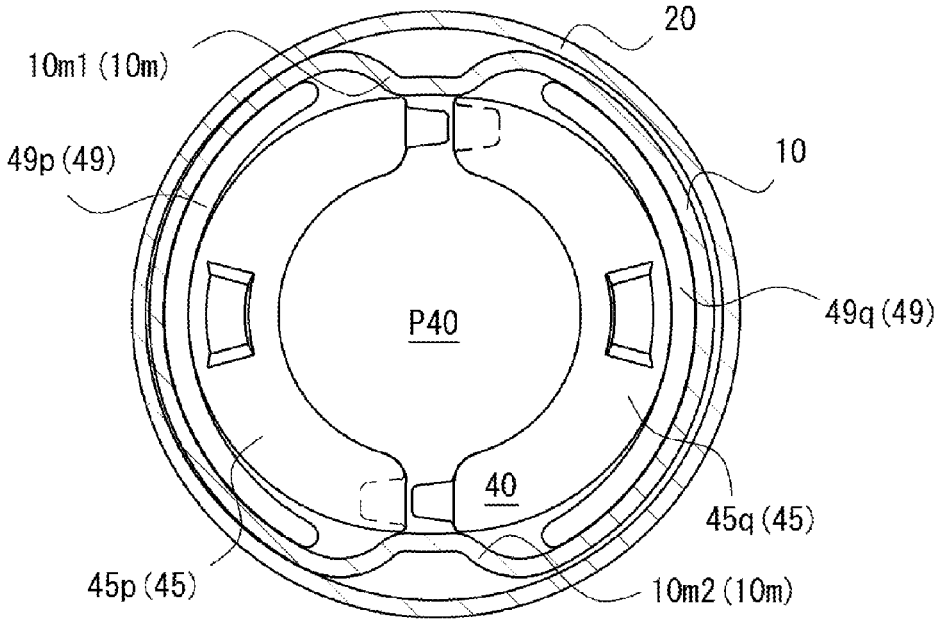
Figure 44:
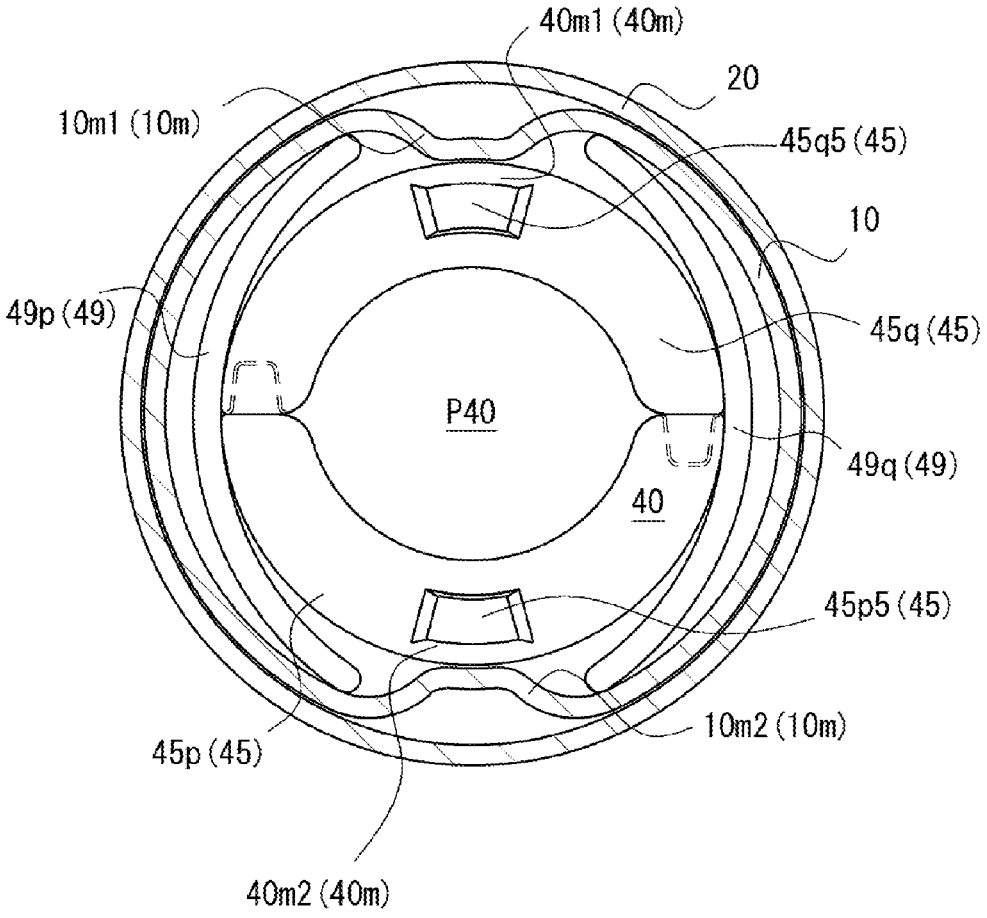
FIG. 44 is a schematic transverse cross-sectional view of a female snap in accordance with an eleventh embodiment of the invention, illustrating a female snap in a locked state.

Eleventh embodiment will be described with reference to FIG. 43 and FIG. 44. FIG. 43 is a schematic transverse cross-sectional view of a female snap, where (a) schematically illustrates the combined state of the U-shaped parts, and (b) schematically illustrates the separated state of the U-shaped parts. FIG. 44 is a schematic transverse cross-sectional view of a female snap, illustrating the female snap under a locked state. In this embodiment, unlike the 9th and 10th embodiments, the leaf springs 49*p*, 49*q* do not displace regardless of the rotation of the rotator 50/the ring body 40. Even in such a configuration, similar effects with the above-described embodiments may be achievable.

Figure 45:
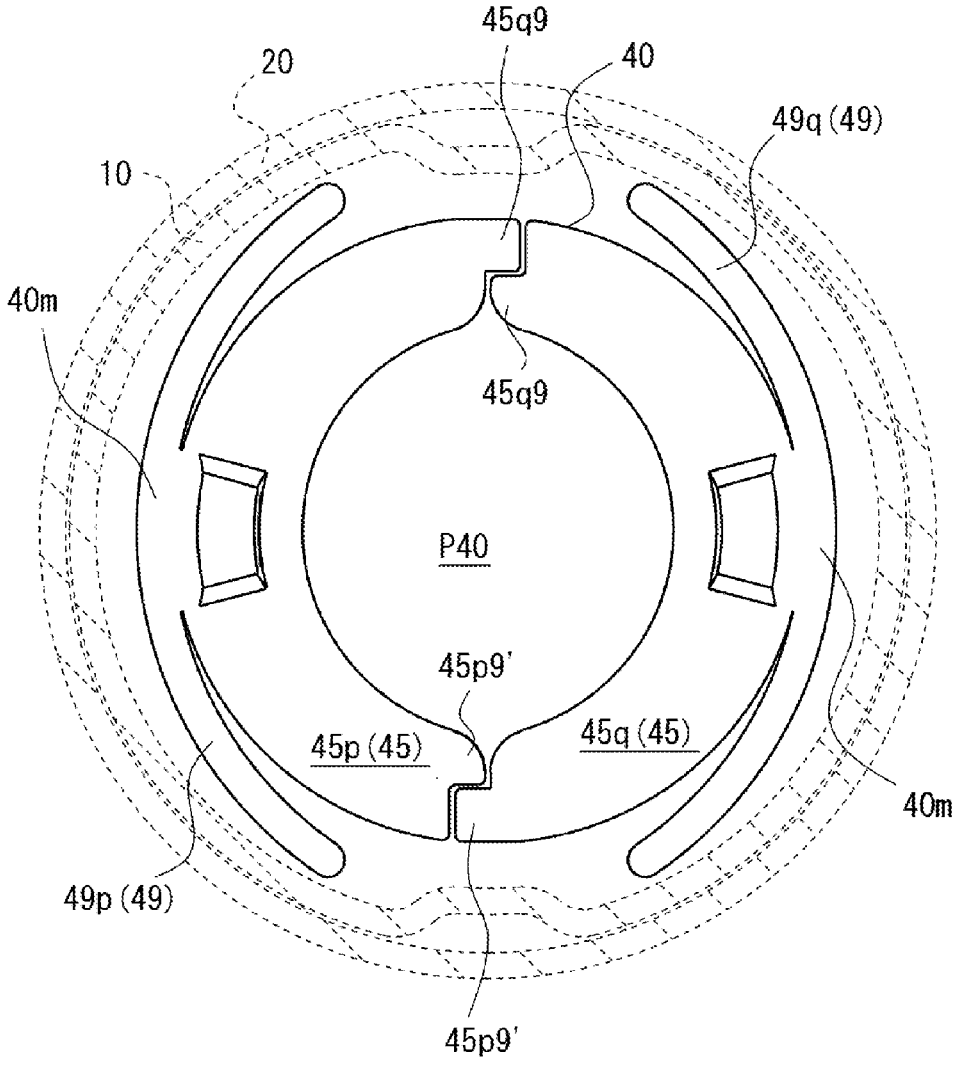
FIG. 45 is a schematic transverse cross-sectional view of a ring body included in a female snap in accordance with a twelfth embodiment of the invention, illustrating a case where a leaf spring is integrally provided with each U-shaped part.

As will be apparent from the comparison of FIG. 43 and FIG. 44, the leaf spring 49 between the ring body 40 and the can body 10 does not displace even the ring body 40 rotates. In 9th embodiment, the leaf spring 49 is engaged with the rotator 50. In 10th embodiment, the structure for entraining the leaf spring 49 is provided at the ring body 40. In contrast, in this embodiment, the leaf spring 49 is just sandwiched between the U-shaped part 45 and the can body 10. Accordingly, simplification in the configuration of the leaf spring 49*p* and the simplification in assembling of the female snap 210 may be facilitated. As shown in FIG. 43 and FIG. 45, the leaf spring 49 is positioned between the two projections 10*m*1, 10*m*2 which are provided at an interval of 180 degrees in the circumferential direction, thus preventing the movement of the leaf spring 49 in the circumferential direction.

Under the unlocked state shown in FIG. 43(*a*) and FIG. 43(*b*), each U-shaped part 45*p*, 45*q* can radially outwardly displace in the can body 10 of the female snap 210, and therefore the space between the arranged U-shaped parts 45*p*, 45*q* is expandable and the aperture P40 of the ring body 40 is expandable. Under the locked state shown in FIG. 44, the U-shaped part 45*p* and the U-shaped part 45*q* between the pair of the press portion 10*m* of the can body 10 are sandwiched between the pair of the press portion 10*m*, where the expansion of the space between the arranged U-shaped part 45*p* and the U-shaped part 45*q* and the expansion of the aperture P40 of the ring body 40 are totally or practically not possible. At a time shown in FIG. 44, the press portion 10*m*1 presses the outer side of the middle portion between both ends of the U-shaped part 45*q*, thus this middle portion may be the pressed portion 40*m*1. The press portion 10*m*2 presses the outer side of the middle portion between both ends of the U-shaped part 45*p*, thus this middle portion may be the pressed portion 40*m*2.

12th Embodiment

Twelfth embodiment will be described with reference to FIG. 45. FIG. 45 is a schematic transverse cross-sectional view of a ring body included in a female snap, illustrating that the leaf spring is integrally provided with each U-shaped part. In this embodiment, unlike 9th to 11th embodiments, the leaf spring 49*p*, 49*q* is integrally provided with the U-shaped part 45*p*, 45*q*. Even in such a configuration, similar effects with 9th to 11th embodiments may be achievable. The unification of the U-shaped part and the leaf spring may be achievable by, but not limited to, making the U-shaped part by a resin and the leaf spring by a metal, and performing an insert-molding to unify them.

As shown in FIG. 45, the unified component of the U-shaped part 45*p* and the leaf spring 49*p* and the unified component of the U-shaped part 45*q* and the leaf spring 49*q* sit side by side in the can body 10. A spring force for making it to be the flat pose from the curved pose is given to the leaf spring 49*p*, 49*q* as described in the 9th embodiment, thereby each unified component being urged radially inwardly.

A salient 45*p*9 at one end of the U-shaped part 45*p* and a salient 45*q*9 at the other end of the U-shaped part 45*q* sit side by side at inner and outer sides in the radial direction, and a salient 45*p*9' at the other end of the U-shaped part 45*p* and a salient 45*q*9' at one end of the U-shaped part 45*q* sit side by side at inner and outer sides in the radial direction. Under such a configuration, the positions of the U-shaped part 45*p* and the U-shaped part 45*q* are restricted in the can body 10 by the fitting therebetween. The embodiments shown in FIGS. 29 to 45 presents a pair of U-shaped parts 45*p*, 45*q* by which an aperture P40 is surrounded and formed. However, 3 or more divided U-shaped parts may be employed.

In view of above descriptions, various modifications may be possibly done with respect to each embodiment by the skilled person in the art. Various configurations may be employed for the male snap and the female snap. Various configurations and material may be employed for the ring body, the ring rotator and so on. It is arbitrary to provide the press portion/pressed portion at either one of the rotator/stationary member. Various approaches may be employed for urging the U-shaped part creased by the division of a ring body, and urging means should not be limited to a leaf spring. The numerals presented in Claims are just for the purpose of reference and should not be construed to narrow the claimed scope.

REFERENCE SIGNS LIST

AX: Axis
200: Snap button
210: Female snap
220: Male snap
230: Fabric
105: Post
P210: Receiving portion
P70: Receiving portion
10: Can body
20: Attachment body
30: Cover
40: Ring body
40*m*: Pressed portion
50: Rotator
57: Press leg
60: Bottom frame
60*m*: Press portion
65: Top frame
70: Ring rotator
70*m*: Pressed portion
80: Grip
91: Holder
91*m*: Press portion
92: Attachment member
93: Attachment plate
94: Decorative plate
95: Mark
110: Plate
120: Plate
130: Attachment body
140: Post

The invention claimed is:

1. A female snap button with which a post of a male snap button is engageable and disengageable, the female snap button comprising:

a first member at least partially-defining an aperture to which the post is inserted, the aperture being capable of expanding in accordance with the insertion of the post, from a first aperture width to a second aperture width that is greater than the first aperture width, and the aperture being capable of automatically recovering, in accordance with the completion of the insertion of the post, from the second aperture width to the first aperture width; and a second member capable of restricting the expansion of the aperture toward the second aperture width so as to increase the required force for engagement or disengagement between the post and the female snap button or so as to prohibit the post from engaging and disengaging with the female snap button;

wherein one of the first and the second members is rotatable relative to the other of the first and second members, wherein the second member comprises at least one contact portion that is to be in contact with the first member, and the first member comprises at least one contacted portion that is to be contacted with the contact portion, wherein while the one of the first and second members is rotated relative to the other of the first and second members the extent of the expansion of the aperture toward the second aperture width allowed by the second member varies in accordance with the relative position of the contact portion and the contacted portion in a circumferential direction that is around an insertion direction of the post into the aperture, and wherein while the one of the first and second members is rotated relative to the other of the first and second members, the width of the aperture at least partially defined by the first member does not reach or exceed the second aperture width.

2. The female snap button according to claim 1, wherein the aperture can recover from the second aperture width to the first aperture width based on elasticity of the first member itself or based on elasticity of at least one elastic member that directly or indirectly acts against the first member.

3. The female snap button according to claim 2 wherein the aperture can recover from the second aperture width to the first aperture width based on the elasticity of the at least one elastic member, wherein the first member is annularly configured and includes first and second U-shaped parts, and wherein the at least one elastic member comprises a leaf spring that couples the first and second U-shaped parts or a leaf spring that urges one of the first and second U-shaped parts toward the other of the first and second U-shaped parts.

4. The female snap button according to claim 2 wherein the aperture can recover from the second aperture width to the first aperture width based on the elasticity of the first member itself, wherein the contacted portion of the first member comprises a projection projecting toward the second member.

5. The female snap button according to claim 4, wherein a height of the projection varies step-by-step in the circumferential direction.

6. The female snap button according to claim 1 wherein the contact portion of the second member comprises a projection radially inwardly projecting toward the first member.

7. The female snap button according to claim 1 wherein the second member is rotatably mounted on the first member, the contact portion of the second member comprises a contact leg that projects from the second member to the first member side in a stacking direction of the first member and the second member.

8. The female snap button according to claim 1, further comprising a rotator that is mounted on the first member and conveys a torque to the first member.

9. A snap button comprising:

e snap button according to claim 1; and a male snap button that comprises the post that is to be inserted to the aperture of the first member of the female snap button.

10. The female snap button according to claim 1, wherein while the one of the first and second members is rotated relative to the other of the first and second members, the aperture defined by the first member maintains at an aperture width substantially equal to the first aperture width.

11. The female snap button according to claim 1, wherein the second member is radially outwardly arranged relative to the first member.

12. The female snap button according to claim 1, wherein the second member comprises a housing member that houses the first member, the housing member including one or more radially inwardly projected press projections.

13. The female snap button according to claim 1, wherein the first member includes:

a plurality of parts arranged in the circumferential direction; and at least one elastic member associated with one or more parts of the plurality of parts, wherein the at least one elastic member is configured to force the first member to have the first aperture width when no force for widening the aperture is applied to the first member.

14. The female snap button according to claim 13, wherein the at least one elastic member includes a first leaf spring radially outwardly arranged relative to the plurality of parts and extending in the circumference direction, or a second leaf spring arranged to couple adjacent parts of the plurality of parts in the circumferential direction.

15. A female snap button comprising:

a first member at least partially defining an aperture and capable of transforming from a first state to a second state in a transformation direction perpendicular to an insertion direction of a post of a male snap, wherein at the first state the post is allowed to pass through the aperture and at the second state the post is restricted from passing through the aperture; and a second member that is capable of restricting the transformation of the first member in the transformation direction, wherein one of the first and second members is rotatable relative to the other of the first and second members, wherein the second member comprises at least one contact portion that is to be in contact with the first member, and the first member comprises at least one contacted portion that is to be contacted with the contact portion, wherein while the one of the first and the second members is rotated relative to the other of the first and second members, the degree of the transformation of the first member allowed by the second member varies in accordance with the relative position of the contact portion of the second member and the contacted portion of the first member in a circumferential direction that is centered around the insertion direction, and wherein while the one of the first and the second members is rotated relative to the other of the first and second members, the width of the aperture at least partially defined by the first member does not reach or exceed an aperture width of the aperture when the first member is at the second state.

16. The female snap button according to claim 15, wherein the transformed first member can recover to the first state based on elasticity of the first member itself or based on elasticity of at least one elastic member that directly or indirectly acts against the first member.

17. The female snap button according to claim 16 wherein the transformed first member can recover to the first state based on the elasticity of the at least one elastic member that directly or indirectly acts against the first member, wherein the first member is annularly configured and includes first and second U-shaped parts, and wherein the at least one elastic member is a leaf spring that couples the first and second U-shaped parts or a leaf spring that urges one of the first and second U-shaped parts toward the other of the first and U-shaped parts.

18. The female snap button according to claim 16 wherein the transformed first member can recover to the first state based on the elasticity of the first member itself, wherein the contacted portion of the first member comprises a projection projecting radially outwardly toward the second member.

19. The female snap button according to claim 15, further comprising a rotator that is mounted on the first member and conveys a torque to the first member.

20. The female snap button according to claim 15, wherein at least one of the first member and the second member is rotatable within a predetermined angular range.

* * * * *